US006488364B1

(12) United States Patent
Nakajima et al.

(10) Patent No.: US 6,488,364 B1
(45) **Date of Patent: *Dec. 3, 2002**

(54) RECORDING METHOD AND APPARATUS FOR CONTROLLING EJECTION BUBBLE FORMATION

(75) Inventors: Kazuhiro Nakajima; Masanori Takenouchi; Toshiharu Inui, all of Yokohama; Yoshihisa Takizawa, Kawasaki; Masashi Miyagawa, Yokohama; Hisao Yaegashi, Kawasaki; Katsuhiro Shirota, Inagi; Norio Ohkuma, Yokohama; Akira Asai, Atsugi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/615,933

(22) Filed: Jul. 13, 2000

Related U.S. Application Data

(62) Division of application No. 08/099,396, filed on Jul. 30, 1993, now Pat. No. 6,155,673, which is a continuation of application No. 07/692,935, filed on Apr. 29, 1991, now abandoned.

(30) Foreign Application Priority Data

| | | |
|---|---|---|
| Apr. 27, 1990 | (JP) | 2-112832 |
| Apr. 27, 1990 | (JP) | 2-112833 |
| Apr. 27, 1990 | (JP) | 2-112834 |
| Apr. 28, 1990 | (JP) | 2-114472 |

(51) Int. Cl.[7] ..... B41J 2/05

(52) U.S. Cl. ..... 347/61

(58) Field of Search ..... 347/56, 61, 62, 347/57

(56) References Cited

U.S. PATENT DOCUMENTS

| | | | |
|---|---|---|---|
| 4,313,124 A | 1/1982 | Hara | 347/57 |
| 4,313,684 A | 2/1982 | Tazaki et al. | 347/37 |

(List continued on next page.)

FOREIGN PATENT DOCUMENTS

| | | | |
|---|---|---|---|
| EP | 0 303 350 | 2/1989 | |
| EP | 0 347 856 | 12/1989 | |
| JP | 54-161935 | 12/1979 | |
| JP | 61-185455 | 8/1986 | |
| JP | 61-197246 | 9/1986 | |
| JP | 61-249768 | 11/1986 | |
| JP | 1-195050 | 8/1989 | |
| JP | 1-258954 | 10/1989 | 347/61 |

OTHER PUBLICATIONS

Asai et al., "Bubble Generation Mechanism in the Bubble Jet Recording Process", Journal of Imaging Technology, vol. 14, No. 5, pp. 120–124, Oct. 1988.

Lee et al., "Heat Wave Phenomena in Thermal Ink Jet", Proceedings—The Fifth International Congress on Advances in Non–Impact Printing Technologies, pp. 554–562, Nov. 1989.

Allen et al., Thermodynamics and Hydrodynamics of Thermal Ink Jets; Hewlett–Packard Journal, vol. 36, No. 5, pp. 21–27, May 1985.

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid jet recording method includes applying thermal energy to liquid in a liquid passage to produce film boiling of the liquid to produce a. bubble; permitting the bubble to communicate with ambience; wherein the liquid passage is not blocked in the communicating step.

31 Claims, 18 Drawing Sheets

U.S. PATENT DOCUMENTS

| | | | | |
|---|---|---|---|---|
| 4,330,787 | A | | 5/1982 | Sato et al. ..... 347/63 |
| 4,334,234 | A | | 6/1982 | Shirato et al. ..... 347/65 |
| 4,337,467 | A | | 6/1982 | Yano ..... 347/56 |
| 4,338,611 | A | | 7/1982 | Eida et al. ..... 347/63 |
| 4,345,262 | A | | 8/1982 | Shirato ..... 347/56 X |
| 4,410,899 | A | | 10/1983 | Haruta et al. ..... 347/56 |
| 4,459,600 | A | | 7/1984 | Sato et al. ..... 347/47 |
| 4,638,337 | A | | 1/1987 | Torpey et al. ..... 347/65 |
| 4,723,129 | A | * | 2/1988 | Endo et al. ..... 347/56 |
| 4,740,796 | A | | 4/1988 | Endo et al. ..... 347/56 |
| 4,740,801 | A | | 4/1988 | Shimazaki ..... 347/66 |
| 4,965,610 | A | | 10/1990 | Ishikawa ..... 347/61 |
| 5,204,689 | A | | 4/1993 | Shirato et al. ..... 347/62 X |
| 5,218,376 | A | | 6/1993 | Asai ..... 347/61 |
| 5,270,730 | A | | 12/1993 | Yaegashi et al. ..... 347/56 |

* cited by examiner

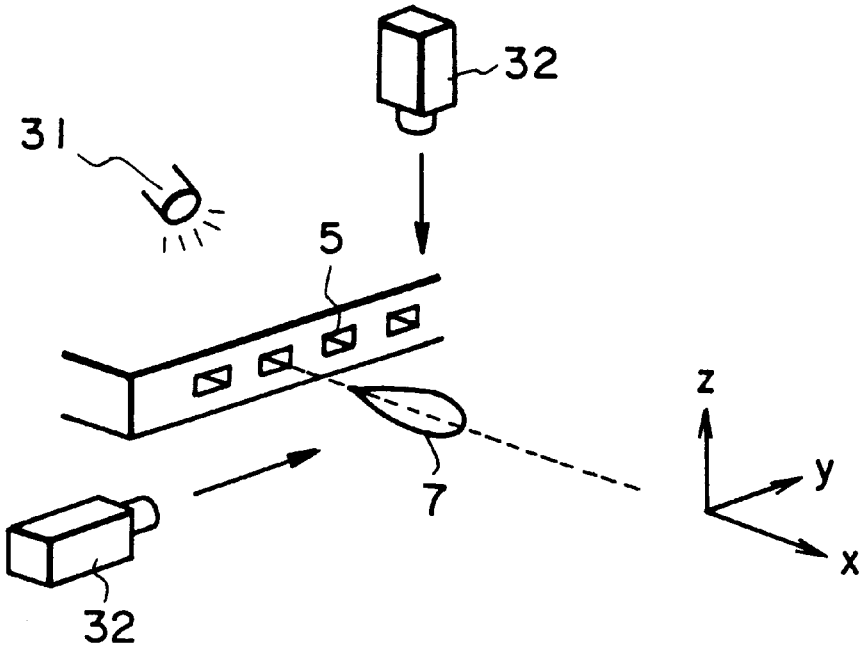
FIG. 2
FIG. 3A
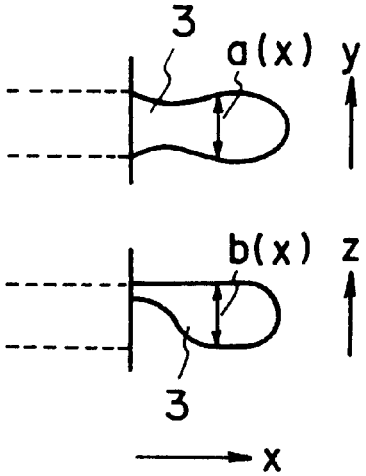
FIG. 3B
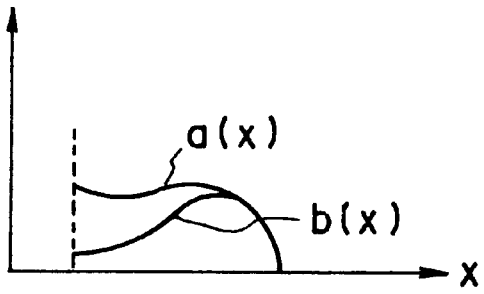
FIG. 3C

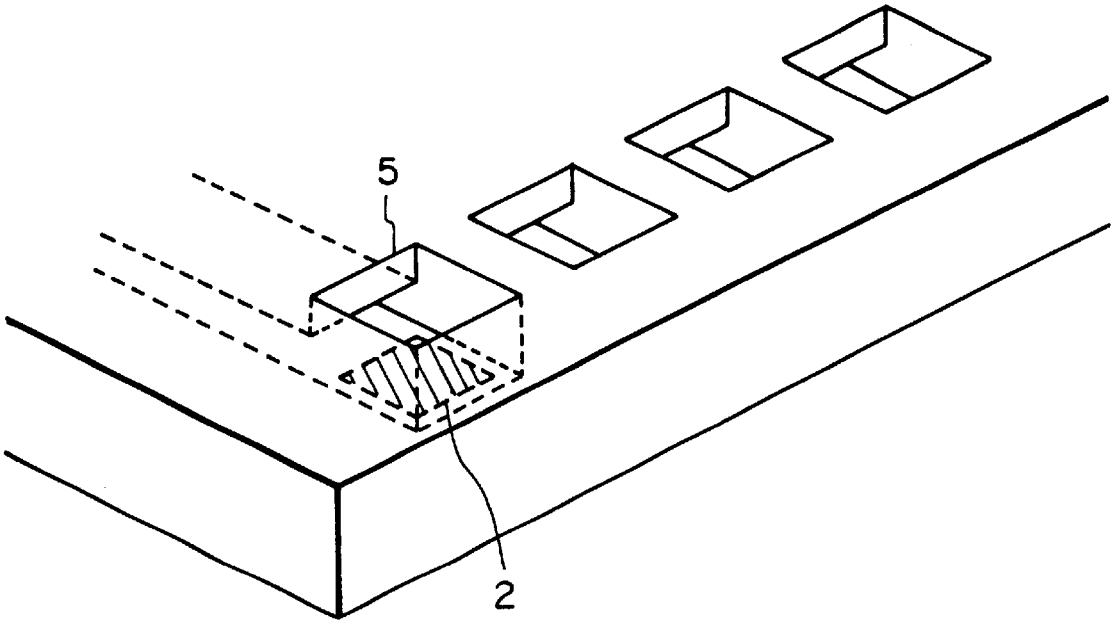
FIG. 9A
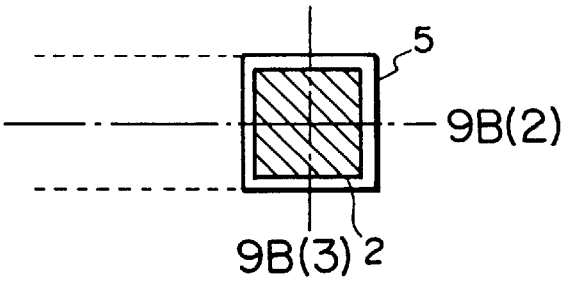
FIG. 9B(1)
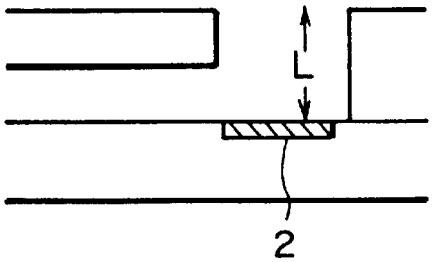
FIG. 9B(2)
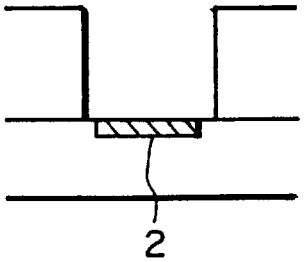
FIG. 9B(3)

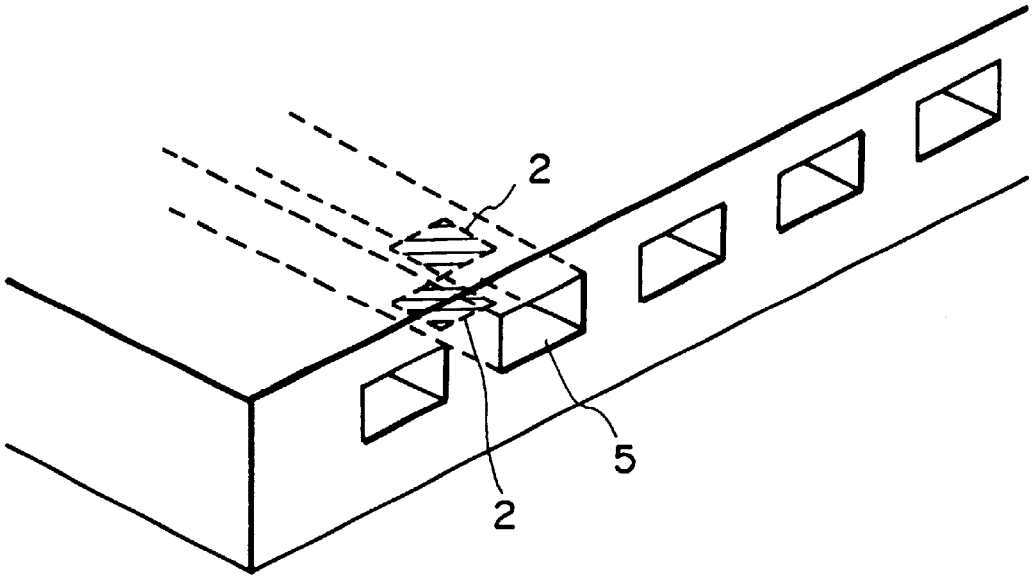
FIG. 18A
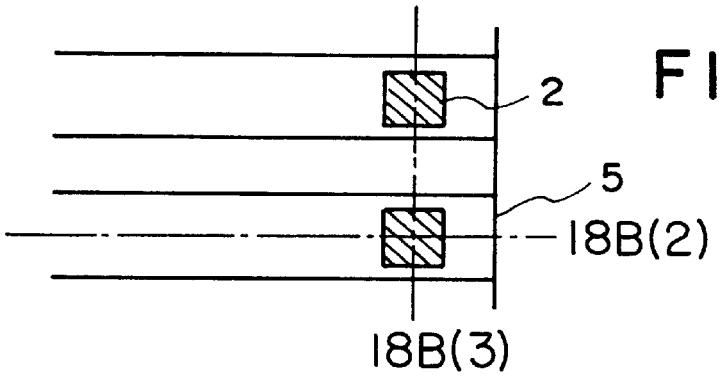
FIG. 18B(1)
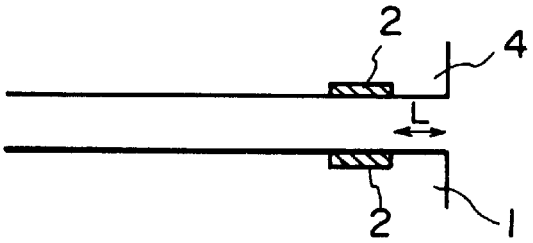
FIG. 18B(2)
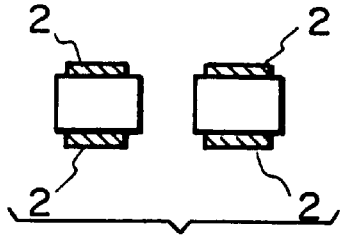
FIG. 18B(3)

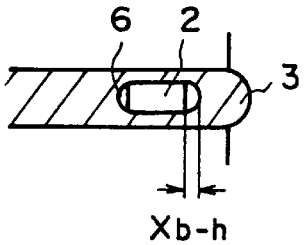
FIG. 22A(1)
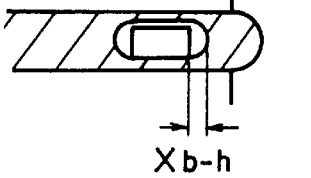
FIG. 22A(2)
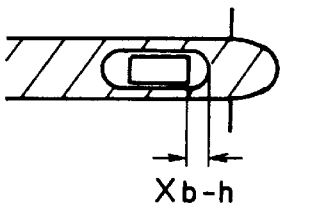
FIG. 22A(3)
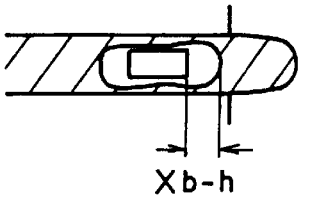
FIG. 22A(4)
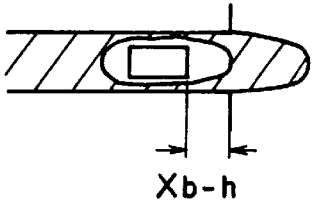
FIG. 22A(5)
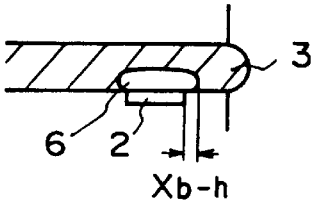
FIG. 22A(6)
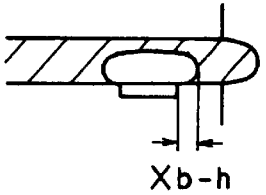
FIG. 22A(7)
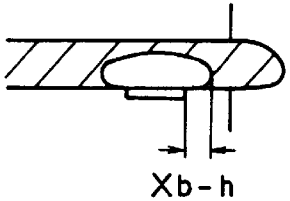
FIG. 22A(8)
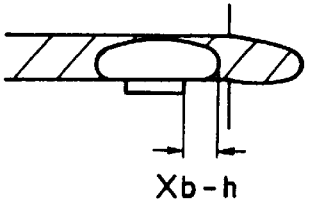
FIG. 22A(9)
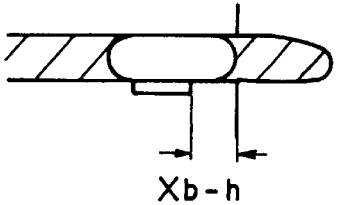
FIG. 22A(10)

FIG. 22B(1)
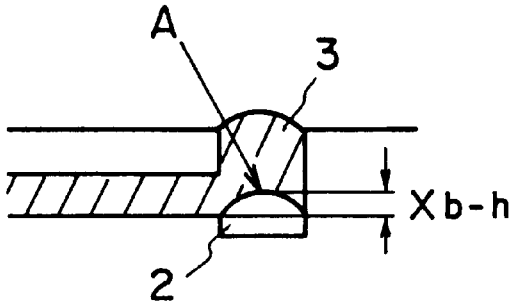
FIG. 22B(2)
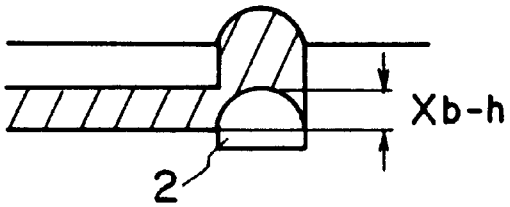
FIG. 22B(3)
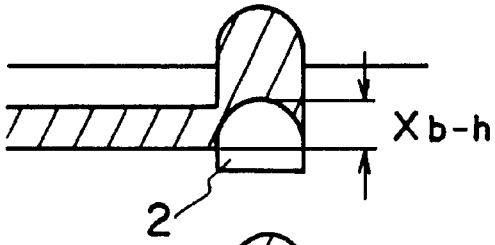
FIG. 22B(4)
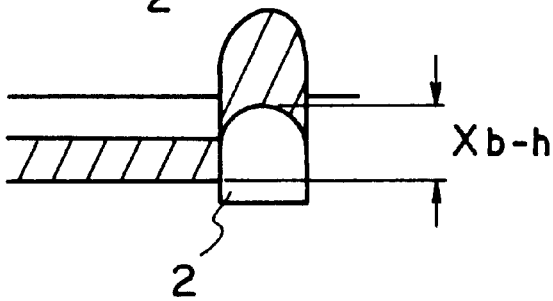

RECORDING METHOD AND APPARATUS FOR CONTROLLING EJECTION BUBBLE FORMATION

This application is a divisional of Application Ser. No. 08/099,396, filed Jul. 30, 1993, now U.S. Pat. No. 6,155,673 which is a continuation of Application Ser. No. 07/692,935, filed Apr. 29, 1991, now abandoned.

FIELD OF THE INVENTION AND RELATED ART

The present invention relates to a recording method and a recording apparatus having a process step by which a bubble produced by thermal energy communicates with ambience, more particularly to a recording method and apparatus such as a printer for recording images or characters on paper or cloth (recording material) in accordance with a recording signal, a copying machine, a facsimile machine having an information transmitting system, an electronic typewriter having a keyboard, a wordprocessor, or a compound system or the like.

Among various recording methods which have been put into practice for various printers, an ink jet system as disclosed in U.S. Pat. Nos. 4,723,129, 4,740,796 or the like, which uses thermal energy to produce film boiling, is advantageous. In one of the types a liquid passage is not blocked by the bubble in U.S. Pat. No. 4,410,899.

The prior art is applicable to various recording systems, but they do not disclose or teach, to the practical level, the system wherein the created bubble communicates with the ambience. This system will be called "ambience communication system".

As one type of the ambience communication system, there is a system in which the bubble explodes. However, since the liquid ejection is not stabilized, it is not practical. Japanese Laid-Open Patent Application No. 161935/1979 discloses a cylindrical nozzle provided with an internal cylindrical heater in which the nozzle is blocked by the bubble, although the ejection principle is not known, but it splashes a great number of fine ink droplets as well as the relatively large major droplet.

Japanese Laid-Open Patent Application No. 185455/1986 discloses that liquid ink is filled in a small clearance between a heat generating head and a plate member having small openings and is heated by the heat generating head to create a bubble to eject a droplet of the ink through the fine opening. Also, the gas forming the bubble is ejected through the fine opening. By doing so, an image is formed on a recording material.

Japanese Laid-Open Patent Application No. 20 249768/1986 discloses that a bubble is formed by application of thermal energy to liquid ink. By the expansion force of the bubble, a small droplet of the ink is formed and ejected. Simultaneously, the gas forming the bubble is ejected through a large opening into the atmosphere. By doing so, an image is formed on the recording material. The system of this publication is characterized by the absence of the wall.

These two publications at most, disclose the ambience communication system by simply stating so or by simply expressing in the drawing. The details of the bubble are not considered.

Japanese Laid-Open Patent Application No. 197246/1986 discloses recording apparatus using thermal energy, in which the ink is supplied into plural bores and is heated by a recording head having heat generating means to the temperature of 150–200° C., by which a droplet of the ink is ejected onto the recording material. However, in the recording apparatus of this type, it is difficult to completely closely dispose the heat generating element and the recording medium, and therefore, the thermal efficiency is not as good as expected, and therefore, it is not suitable for a high speed recording, as the case may be. This publication discloses ejection of the ink using the pressure of the created bubble, but it does not disclose the specific principles of ejection. Therefore, any solution to the problem is not even suggested. This publication shows in its FIG. 3 the growth of the bubble, in which the bubble growth from a point, and therefore, it is understood that the bubble is created by an extension of the nucleate boiling. In addition, the communication between the bubble and the air occurs in a space away from the ejection outlet, and therefore, the ejection behavior is not stabilized in addition, the ink remains around the ejection outlet.

SUMMARY OF THE INVENTION

The present invention is intended to provide a practical solution to the problems with the ambience communication system ink jet recording apparatus. The present invention is based on new investigations and analysis as to the preferable conditions under which the bubble communicates with the ambience.

Accordingly, it is a principal object of the present invention to provide a recording method and apparatus wherein the splashing of the liquid due to the explosion of the bubble is suppressed.

It is another object of the present invention to provide a recording method and apparatus wherein the liquid droplet formation is stabilized.

It is a further object of the present invention to provide a recording method and a recording apparatus wherein the bubble communicates with the ambience under preferable conditions.

It is a further object of the present invention to provide a recording method and apparatus wherein the bubble communicates with the ambience under such a condition that the volume and the speed of the ejected droplet are stabilized.

It is a further object of the present invention to provide an on-demand recording method and a on-demand type recording apparatus wherein plural ejection outlets are arranged at a high density without the problem of undesirable temperature rise.

It is a further object of the present invention to provide an on-demand recording method and an on-demand recording apparatus which is excellent in the image quality and in the high frequency response.

It is a further object of the present invention to provide a recording method and a recording apparatus having a long service life.

It is a further object of the present invention to provide a recording method and a recording apparatus which is stable in the recording operation.

It is a further object of the present invention to provide a recording method and a recording apparatus which have plural liquid passages with good refilling property.

According to an aspect of the present invention, there is provided a liquid jet recording method, comprising: applying thermal energy to liquid in a liquid passage to produce film boiling of the liquid to produce a bubble; permitting the bubble to communicate with ambience; wherein the liquid passage is not blocked in the communicating step.

According to another aspect of the present invention, there is provided a liquid jet recording method wherein ink is heated to create a bubble which is effective to eject at least a part of the ink, the improvement resides in that the bubble communicates with ambience under the condition that an internal pressure of the bubble is lower than a pressure of the ambience.

According to a further aspect of the present invention, there is provided a recording method using a recording head including an ejection outlet for ejecting ink, a liquid passage communicating with the ejection outlet and an ejection energy generating means for generating thermal energy contributable to ejection of the ink by creation of a bubble in the liquid passage, wherein the bubble communicates with the ambience when $l_a/l_b \geqq 1$ is satisfied, where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet.

According to a yet further aspect of the present invention, there is provided a liquid jet method using a recording head having an ejection outlet for ejecting ink, a liquid passage communicating with the ejection outlet and an ejection energy generating element for generating thermal energy contributable to the ejection of the ink by creation of a bubble in the liquid passage, wherein a first order differential of a movement speed of an ejection outlet side end of the created bubble is negative, when the bubble created by the ejection energy generating means communicates with the ambience through the ejection outlet.

These and other objects, features and advantages of the present invention will become more apparent upon a consideration of the following description of the preferred embodiments of the invention taken in conjunction with the accompanying drawings.

BRIEF DESCRIPTION OF THE DRAWINGS

FIG. 1B is a sectional view along a plane including the longitudinal center, and FIG. 1C is a sectional view similar to FIG. 1B but taken-along a plane closer to a lateral wall.

FIG. 2 illustrates a method of measuring a volume of a droplet.

FIGS. 3A–3C show a top plan view and a side view of the ejected liquid and a graph of the volume of the ejected liquid respectively.

FIGS. 9A and 18A are perspective views of recording heads according to embodiments of the present invention.

FIGS. 9B(1)–9B(3) 10A–10C, 11A–11C, 12A–12C, 13A–13C, 14A–14C, 15A–15C, 16A–16C, 17A–17C, 18B(1)–18B(3), 19A–19B, 20A–20B and 20C show the recording heads according to embodiments of the present invention.

FIGS. 22A(1)–22A(10) and 22B(1)–22B(4) illustrate movement of the leading edge of the bubble per unit time. FIGS. 22A(1)–22A(5) (the left side views) are top plan views; and FIGS. 22A(6)–22A(10) (the right side views) are side views at the corresponding time.

DESCRIPTION OF THE PREFERRED EMBODIMENTS

Figure 1A:
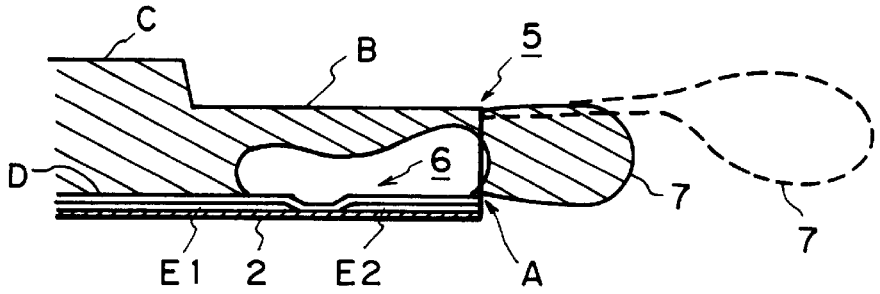
FIGS. 1A, 1B and 1C schematically illustrate communication of a bubble with the ambience (atmosphere)
Figure 1B:
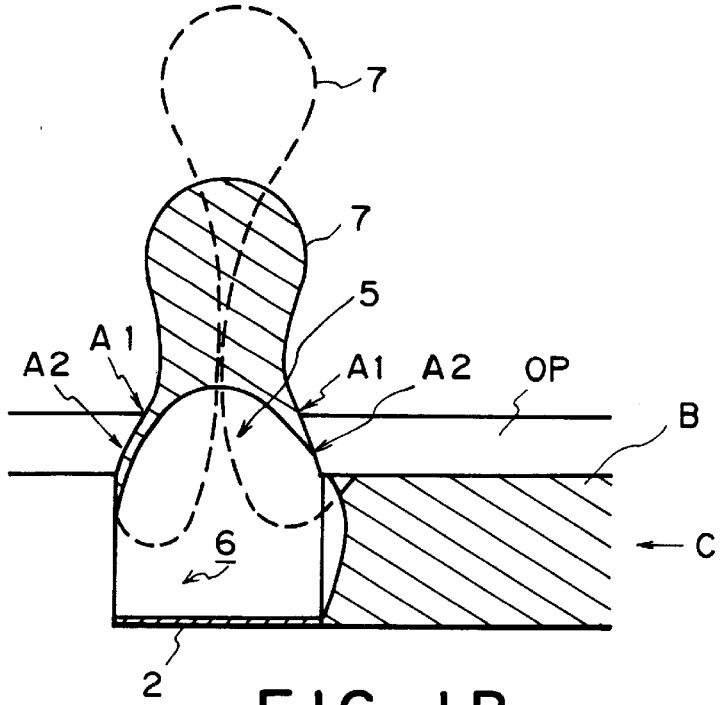

FIGS. 1A and 1B shows typical examples of liquid passages using the present invention. However, the present invention is not limited to these structures, as will be understood from the descriptions which will be made hereinafter.

In FIG. 1A, a heat generating resistor layer is provided on a unshown base plate, and a plurality of ejection outlets 5 are provided at an edge of the base plate. A selecting electrodes E1 and a common electrode E2 have the known structures. Designated by reference characters D and C are a protection layer and a common liquid chamber, respectively.

In response to electric signals in the form of pulse signals in accordance with the recording signals supplied by the electrodes E1 and E2, the temperature of the heat generating portion between the electrodes E1 and E2 instantaneously rises to cause film boiling (not less than 300° C.), by which a bubble 6 is produced. In the embodiments of the present invention, the bubble 6 communicates with the ambience at its edge A adjacent the heat generating resistor layer 2 to produce a stabilized liquid droplet (broken line 7). Since the bubble communicates with the ambience (atmospheric air) adjacent the edge of the ejection outlet opening 5, the droplet of the ink can be created without splashing of the liquid and without the production of the mist. The thus produced droplet of the liquid is ejected and deposited on the recording material.

The recording principle is such that the liquid passage B is not completely blocked by the bubble 6 during the growth thereof. So, the ink refilling after the ejection is effected in good order. The accumulated heat by the high temperature (not less than 300° C.) is ejected into the ambience, and therefore, the frequency of the response is increased.

In FIG. 1B, the common liquid chamber C is not shown. The liquid passage B is bent, as contrasted to FIG. 1A structure, and the heat generating resistor 2 is provided on the surface of the base plate at the bent portion. The ejection outlet has a crosssection decreasing in the direction of the ejection and is faced to a heat generating resistor 2. The ejection outlets are formed in an orifice plate OP.

Figure 1C:
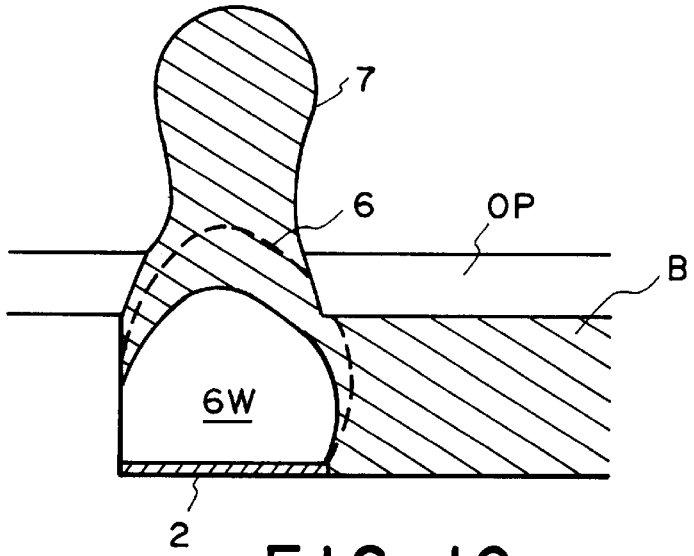

Similarly to the structure of FIG. 1A, the film boiling (not less than 300° C.) is caused, by which the bubble 6 develops to displace the ink in the thickness of the orifice plate OP. The bubble 6 communicates with the ambience in a region between A1 which is an outside edge of the ejection outlet opening and A2 which is adjacent to the ejection outlet opening. With this state of communication, a stabilized liquid droplet as shown by the broken line 7 can be ejected along the center of the ejection outlet without the splashing of the liquid and without the production of the mist. The growth of the bubble does not block the liquid passage. More particularly, as will be understood from FIG. 1C, when the bubble communicates with the ambience, the bubble does not completely block the passage. Rather, the liquid which is going to constitute the droplet is partly connected with the liquid in the liquid passage. This increases the speed of the refilling of the liquid in the passage. In addition, the connection between the outside liquid and the inside liquid is effective to provide good shape of the droplet as shown in FIG. 1B by the reference numeral 7, so that the satellite droplets are formed in a stabilized manner. Furthermore, the liquid not required to displace toward the ejection outlet can remain in the liquid passage as the mass of the liquid, continuous with the remaining liquid, and therefore, the volume and the speed of the droplet 7 can be stabilized.

In the embodiments of the present invention, the bubble develops at a high speed toward the ejection outlet using the stabilized film boiling (particularly not less than 300° C.), and therefore, the high speed recording is possible with high stability with the aid of good refilling property of the liquid passage which is not blocked by the bubble.

The description will be made as to the preferable conditions which may be incorporated individually or in combination in the structures shown in FIG. 1A or 1B to provide significantly better liquid droplet formation.

The first condition is that the bubble communicates with the ambience under the condition that the internal pressure of the bubble is lower than the ambient pressure. The communication under such a condition is preferable since then the unstable liquid adjacent the ejection outlet is prevented from scattering, although such liquid is scattered when the condition is not satisfied. In addition, it is advantageous in that the force, if not large, is applied to the instable liquid in the backward direction, by which the liquid ejection is further stabilized, and the unnecessary liquid splash can be suppressed.

The second condition is that the bubble communicates with the ambience under the condition that the first order differential of a movement speed of the front edge (the edge adjacent to the ejection outlet) of the bubble is negative.

The third condition is that the bubble communicates with the ambience under the condition of $\underline{l}_a/\underline{l}_b>1$, where $\underline{l}_a$ is a distance from an ejection outlet side edge of the ejection energy generating means to the ejection outlet side edge of the bubble, and $\underline{l}_b$ is a distance from that edge of the energy generating means remote from the ejection outlet to that edge of the bubble remote from the ejection outlet. It is further preferable that the second and third conditions are simultaneously satisfied.

Referring to FIGS. 2 and 3A–3C, the description will be made as the method of measurement.

First, the measuring method of ink volume Vd outside the ejection outlet will be dealt with. The configurations of the liquid droplet at the respective times after the ejection are determined by observation through a microscope 32 while the liquid droplet being ejected through the ejection outlet is illuminated with pulse light using a proper light source 31 such as stroboscope, LED or laser. More particularly, the recording head is driven continuously at a constant frequency, and the pulse light is emitted in synchronism with the driving pulse and with a predetermined delay, by which the configuration of the liquid droplet projected in a direction after a predetermined period from the ejection can be determined. At this time, the pulse width of the pulse light is desirably as small as possible, provided that the quantity of light sufficient for the measurement is assured, since then the measurement is accurate. The volume of the droplet can be measured on the basis of measurement in one direction. However, for further accuracy, the following method is desirable.

Referring to FIG. 2, the projective configurations of the ejected liquid droplet is observed through the microscope simultaneously in orthogonal directions y and z which are perpendicular to the X-axis, which is the ejection direction of the liquid droplet, while the droplet is illuminated with he pulse light described above. The direction y of he measurement through the microscope or the direction z is preferably parallel to the direction of the array of the ejection outlets.

Referring to FIGS. 3A–3C, the widths $\underline{a}(x)$ and b(x) of the liquid droplet, along the X-axis, of the liquid droplet are measured on the images obtained in the two directions ((a) and (b)). Using the widths as the function of x, the volume Vd of the liquid droplet after a predetermined period after the ejection can be calculated by the following equation:

$$Vd=(\pi/4)\int a(x)\cdot b(x)dx$$

The equation is based on approximation of y-z cross-section to an oval shape. The approximation provides sufficiently high accuracy for the calculations for the liquid droplet or the bubble volume which will be described hereinafter.

Further, by gradually changing the delay period of the pulse light from zero, the change of the droplet volume Vd after the application of the driving pulse is effected.

The same applies to the measurement of the bubble volume in the liquid passage.

After the preparation is made for observation of the bubble in the liquid passage, it is illuminated with pulse light in the two directions in the same manner as in the method of measuring the droplet volume, so that the projective configurations are determined. Then, using the above equation, the volume can be determined.

In order to determine the behavior of the liquid droplet or the bubble, the required time resolution power is approximately 0.1 micro-sec. In consideration of this, the pulse light source is in the form. of an infrared LED, and the pulse width thereof is approximately 50 msec. An infrared camera is connected to the microscope to photograph the image, from which the above-described a(x) and b(x) are determined. Then, the above-described equation is used.

In another method, a gas flow is used to determine which is larger the internal pressure of the bubble or the ambient pressure. This will be described.

In this method, the gas flow (motion of the gas) resulting from the pressure difference between the inside and outside of the bubble at the instance when the bubble communicates with the ambience is determined. A fine tuft is disposed adjacent the ejection outlet, and the motion of the tuft caused by the gas flow is observed by the microscope. Otherwise, the change in the density of the air adjacent the ejection outlet caused by the flow is detected through an optical method or the like such as Schlieren method, Mach-Zehnder interferometer method or hologram method or the like.

If an outward gas flow from the liquid passage side is observed at the instance when the bubble communicates with the ambience by the method, it is understood that the communication occurs when the internal pressure of the bubble is higher than the ambient pressure. If an inward gas flow into the liquid passage is observed, it is understood that the communication occurs when the internal pressure of the bubble is lower than the ambient pressure.

The description will be made as to the structure of the recording head used in the present invention.

Figure 4A:
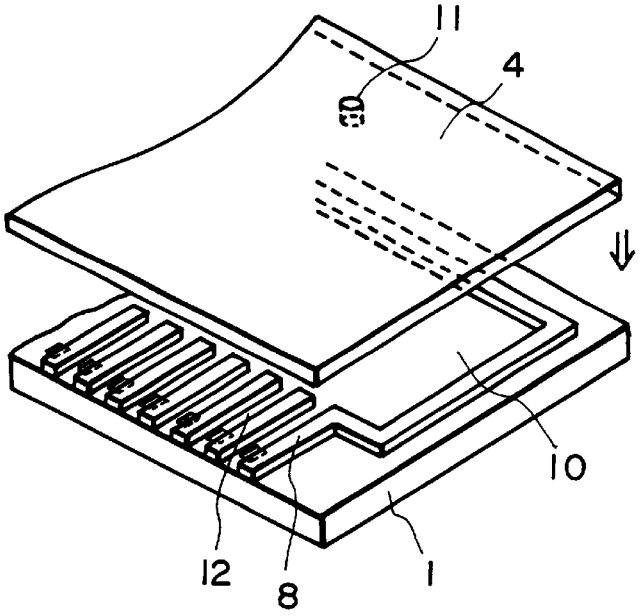
FIGS. 4A and 4B illustrate a recording head according to an embodiment of the present invention.
Figure 4B:
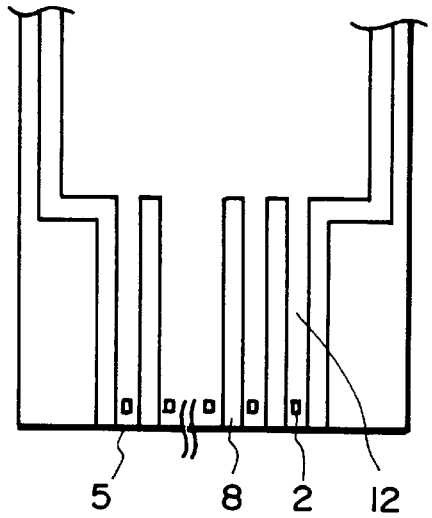

FIGS. 4A and 4B are a perspective view of a preferable recording head before the assembling thereof and a top plan view thereof. In FIG. 4B, the top plate shown in FIG. 4A is omitted.

The structure of the recording head shown in FIGS. 4A and 4B will be described. It comprises a base member 1 having walls 8, and a top plate 4 secured on the tops of the walls 8. By the joining, both of the liquid passages 12 and the common liquid chamber 10 are formed. The top plate 4 is provided with a supply opening 11 for supplying the ink, and the ink is supplied into the liquid passage 12 through the common liquid chamber 10 to which the liquid passages 12 communicates.

The base member 1 is provided with heaters 2, and for each of the heaters 2, the liquid passages are formed. The heater 2 has a heat generating resistor layer (not shown) and an electrode (not shown) electrically connected with the heat generating resistor layer. The heater 2 is energized through the electrode in accordance with the recording signal. Upon the energization, the heater 2 generates thermal energy to supply the thermal energy to the ink supplied into the liquid. The thermal energy produces a bubble in the ink in accordance with the recording signal.

Another structure of the recording head usable with the present invention will be described.

Figure 5A:
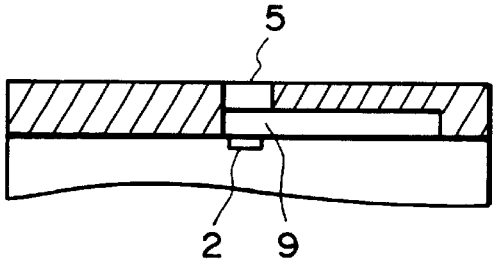
FIGS. 5A and 5B show a recording head according to another embodiment of the present invention.
Figure 5B:
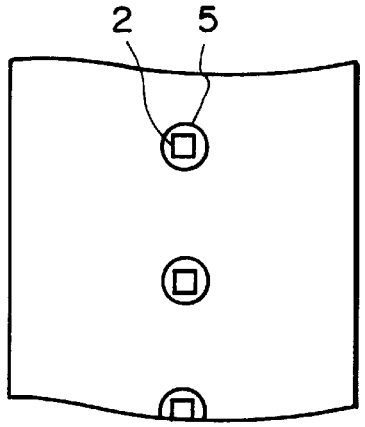

Referring to FIGS. 5A and 5B, there is shown a sectional view of the recording head and a top plan view. The prior difference of the recording head and the recording head shown in FIG. 5 is that the ink supplied into the liquid passage is ejected along or substantially along the liquid passage direction, whereas in FIGS. 5A and 5B, the ink is ejected at an angle from the ink passage (the ejection outlet is formed directly above the heater).

In FIGS. 5A and 5B, the same reference numerals as in the FIGS. 4A and 4B are assigned to the elements having the corresponding functions.

In FIGS. 5A and 5B, the ejection outlets 5 are formed in an orifice plate 16, and it integrally has walls 9 between the ejection outlets 5.

FIGS. 6A–6E are graphs of bubble internal pressure vs. volume change with time in a first specific liquid jet method and apparatus according to a first specific embodiment of the present invention.

This aspect of the present invention is summarized as follows:

(1) A liquid jet method wherein a bubble is produced by heating ink to eject at least a part of the ink by the bubble, and wherein the bubble communicates with the ambience under the condition that the internal pressure of the bubble is not higher than the ambient pressure.

(2) A recording apparatus including a recording head having an ejection outlet through which at least a part of ink is discharged by a bubble produced by heating the ink by an ejection energy generating means, a driving circuit for driving the ejection energy generating means so that the bubble communicates with the ambience under the condition that the internal pressure of the bubble is not more than the ambient pressure, and a platen for supporting a recording material to face the ejection outlet.

According to the specific embodiment of the present invention, the volume and the speed of the discharged liquid droplets are controlled so that the splash or mist which is attributable to the incapability of sufficiently high speed record can be suppressed. The contamination of the background of images can be prevented. When the present invention is embodied as an apparatus, the contamination of the apparatus can be prevented. The ejection efficiency is improved. The clogging of the ejection outlet or the passage can be prevented. The service life of the recording head is expanded with high quality of the print.

Referring to FIGS. 7A–7F, the principle of liquid ejection will be described, before FIGS. 6A–6E are described. The liquid passage is constituted by a base 1, a top plate 4 and unshown walls.

Figure 7A:
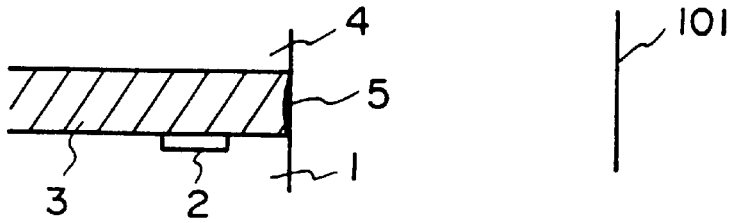
FIGS. 7A–7F illustrate ejection of the liquid in a recording method and a recording apparatus according to another specific embodiment of the present invention.
Figure 7B:
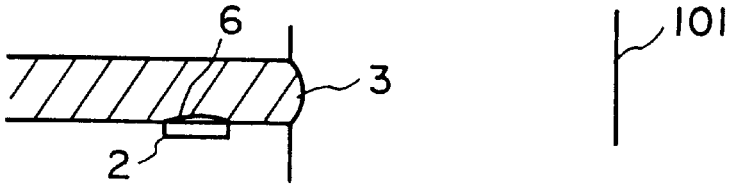
Figure 7C:
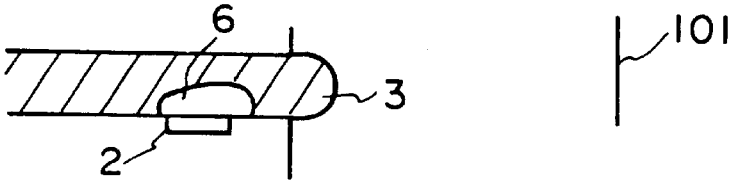

FIG. 7A shows the initial state in which the passage is filled with ink 3. The heater 2 (electro-thermal transducer, for example) is instantaneously supplied with electric current, the ink adjacent the heater 2 is abruptly heated by the pulse of the current, upon which a bubble 6 is produced on the heater 2 by the so-called film boiling, and the bubble abruptly expands (FIG. 7B). The bubble continues to expand toward the ejection outlet 5, that is, in the direction of low intertia resistance. It further expands beyond the outlet 5 so that it communicates with the ambience (FIG. 7C). At this time, the ambience is in equilibrium with the inside of the bubble 6, or it enters the bubble 6.

Figure 7D:
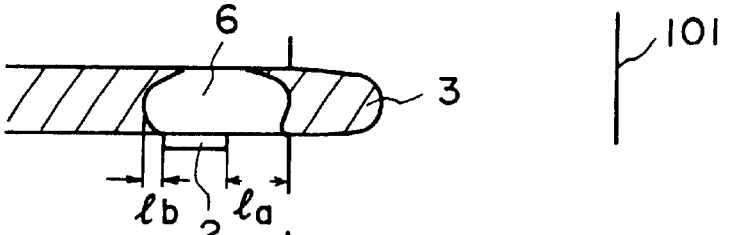
Figure 7E:
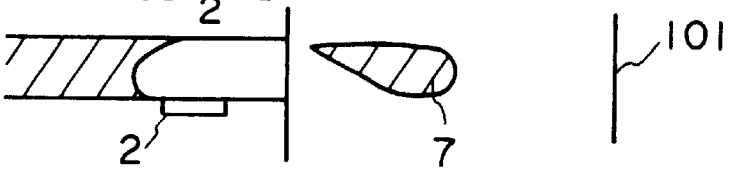

The ink 3 pushed out by the bubble through the outlet 5 moves forward further by the momentum given by the expansion of the bubble, until it becomes an independent droplet and is deposited on a recording material 101 such as paper (FIG. 7D). The cavity produced adjacent the outlet 5 is supplied with the ink from behind by the surface tension of the ink 3 and by the wetting with the member defining the liquid passage, thus restoring the initial state (FIG. 7E). The recording medium 101 is fed to the position faced to the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween. What is required is the relative movement therebetween to face the outlet to a desired position of the recording material.

In FIG. 7C, in order that the gas does not move between the bubble 6 and the ambience, or the ambient gas or gasses enter the bubble, at the time when the bubble 6 communicates with the ambience, it is desirable that the bubble communicates with the ambience under the condition that the pressure of the bubble is equal to or lower than the ambient pressure.

Figure 6A:
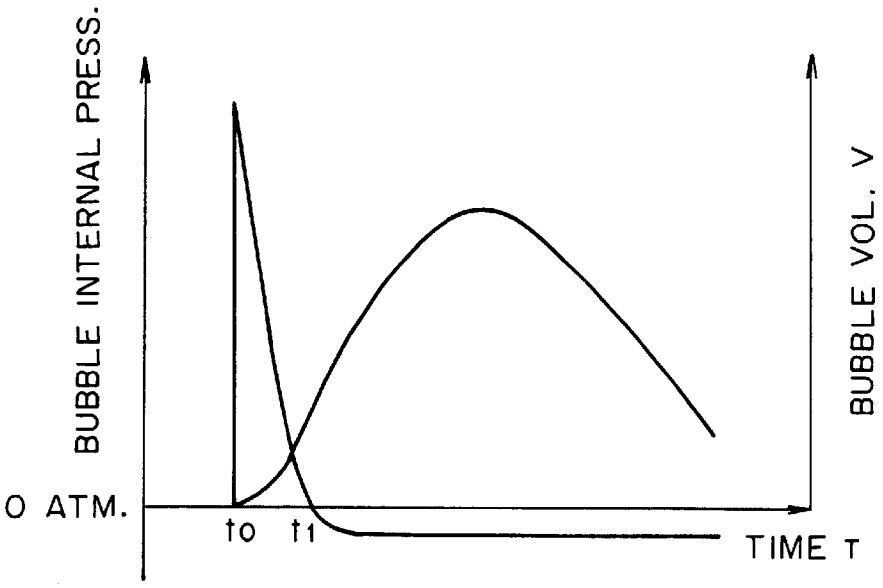
FIGS. 6A, 6B, 6C, 6D and 6E are graphs of the changes of the internal pressure and the volume of a bubble with time in the recording apparatus and recording method according to a specific embodiment according to the present invention.
Figure 6B:
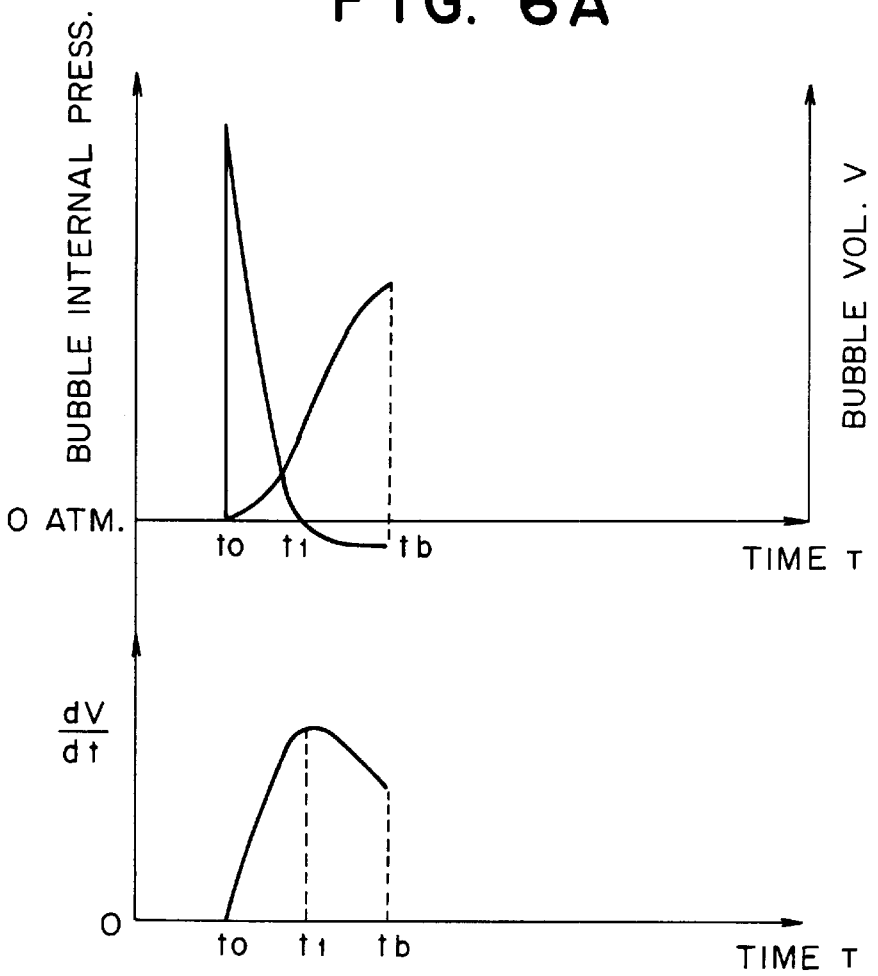

In order to satisfy the above, the bubble is made to communicate with the ambience in the period satisfying $t \geqq t1$ in FIG. 6A. Actually, however, the relation between the bubble internal pressure and the bubble volume with the time is as shown in FIG. 6B, because the ink is ejected by the expansion of the bubble. Thus, the bubble is made to communicate with the ambience in the time satisfying $t=tb$ ($t1 \leqq tb$) in FIG. 6C.

The ejection of the droplet under this condition is preferable to the ejection with the bubble internal pressure higher than the ambient pressure (the gas ejects into the ambience), in that the contamination of the recording paper or the inside of the apparatus due to the ink mist or splash. Additionally, the ink acquires sufficient energy, and therefore, a higher ejection speed, because the bubble communicates with the ambience only after the volume of the bubble increases.

In addition, it is further preferable to let the bubble communicate with the ambience under the condition that the bubble internal pressure is lower than the external pressure, since the above-described advantages are further enhanced.

The lower pressure communication is effective to prevent the unstabilized liquid adjacent the outlet from splashing which otherwise is liable to occur. In addition, it is advantageous in that the force, if not large, is applied to the unstabilized liquid in the backward direction, by which the liquid ejection is further stabilized, and the unnecessary liquid splash can be suppressed.

In a first specific embodiment, the recording head has the heater 2 adjacent to the outlet 5. This is the easy arrangement to make the bubble communicate with the ambience. However, the above-described preferable condition is not satisfied by simply making the heater 2 close to the outlet. The proper selections are made to satisfy it with respect to the amount of the thermal energy (the structure, material, driving conditions, area or the like of the heater, the thermal capacity of a member supporting the heater, or the like), the nature of the ink, the various sizes of the recording head (the distance between the ejection outlet and the heater, the widths and heights of the outlet and the liquid passage).

As a parameter for effectively embodying the first specific embodiment, there is a configuration of the liquid passage, as described hereinbefore. The width of the liquid passage is substantially determined by the configuration of the used thermal energy generating element, but it is determined on the basis of rule of thumb. However, it has been found that the configuration of the liquid passage is significantly influential to growth of the bubble, and that it is an effective factor.

It has been found that the communicating condition can be controlled by changing the height of the liquid passage. To be less vulnerable to the ambient condition or the like and to be more stable, it is desirable that the height of the liquid passage is smaller than the width thereof ($H<W$).

It is also desirable that the communication between the bubble and the ambience occurs when the bubble volume is not less than 70%, further preferably, not less than 80% of the maximum volume of the bubble or the maximum volume which will be reached before the bubble communicates with the ambience.

The description will be made as to the method of measuring the relation between the bubble internal pressure and the ambient pressure.

It is difficult to directly measure the pressure in the bubble and therefore, the pressure relation between them is determined in one or more of the following manners.

First, the description will be made as to the method of determining the relation between the internal pressure and the ambient pressure on the basis of the measurements of the change, with time, of the bubble volume and the volume of the ink outside the outlet.

Figure 6C:
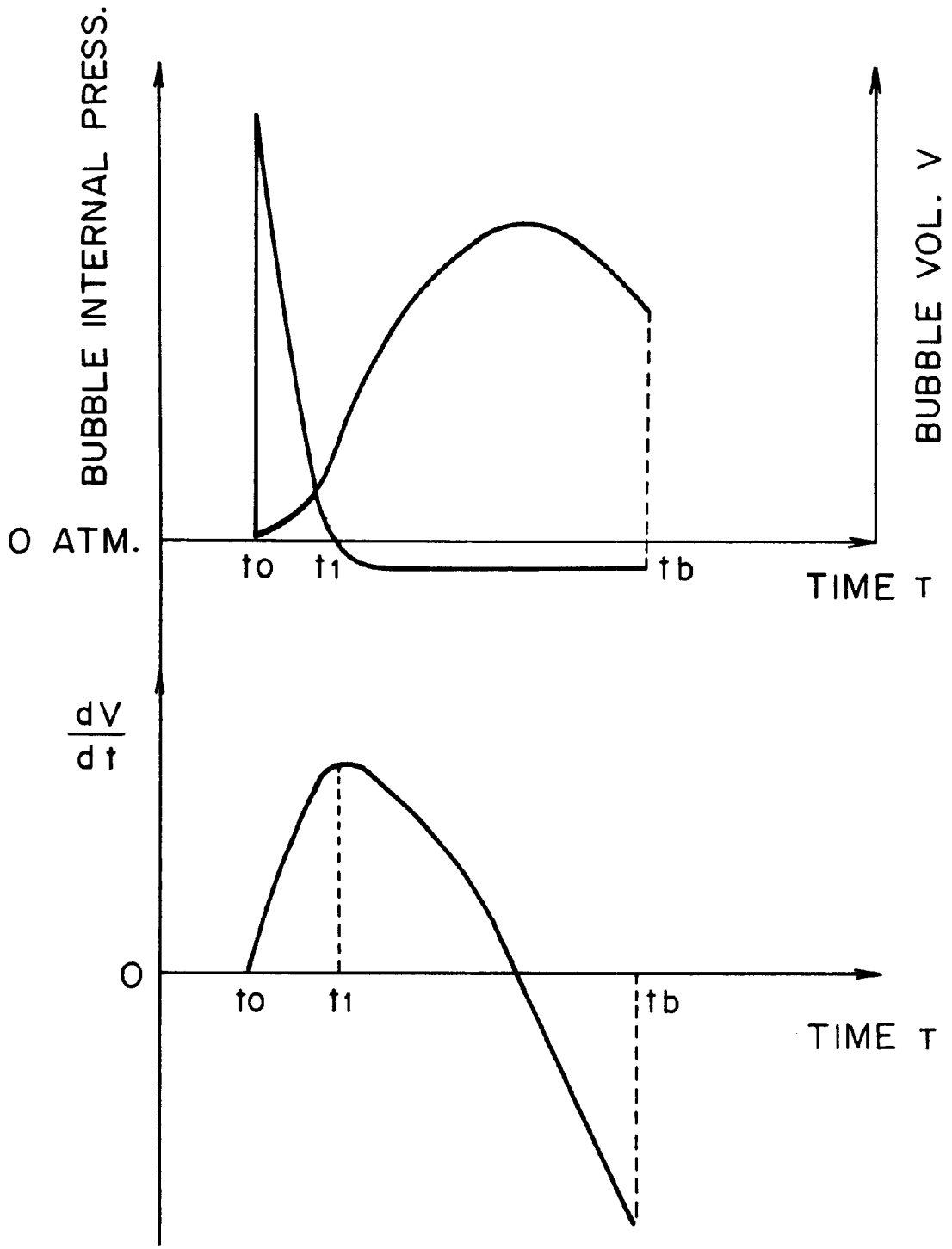

The volume V of the bubble is measured from the start of the bubble creation to the communication thereof with the ambience. Then, the second order differential $d^2V/dt^2$ is calculated, by which the relation (which is larger) between the internal pressure and the ambient pressure is known, because if $d^2V/dt^2>0$, the internal pressure of the bubble is higher than the external pressure, and if $d^2V/dt^2 \leqq 0$, the internal pressure is equal to or less than the external pressure. Referring to FIG. 6C, from the time $t=t_0$ to the time $t=t_1$, the internal pressure is higher than the external pressure, and $d^2V/dt^2>0$; from the time $t=t_1$ to the time $t=t_b$ (occurrence of communication), the internal pressure is equal to or less than the ambient pressure, and $d^2V/dt^2 \leqq$. Thus, by determining the second order differential of the volume V, ($d^2V/dt^2$), the higher one of the internal and external pressure is determined.

Here, it is required that the bubble can be observed directly or indirectly from the outside. In order to permit observance of the bubble externally, a part of the recording head is made of transparent material. Then, the creation, development or the like of the bubble is observed from the outside. If the recording head is of non-transparent material, a top plate or the like of the recording head may be replaced with a transparent plate. For the better replacement from the standpoint of equivalency, the hardness, elasticity and the like are as close as possible with each other.

If the top plate of the recording head is made of metal, non-transparent ceramic material or colored ceramic material, it may be replaced with transparent plastic resin material (transparent acrylic resin material) plate, glass plate or the like. The part of recording head to be replaced and the material to replace are not limited to the described above.

In order to avoid difference in the nature of the bubble formation or the like due to the difference in the nature of the materials, the material to replace preferably has the wetting nature relative to the ink or another nature which is as close as possible to that of the material replaced. Whether the bubble creation is the same or not may be confirmed by comparing the ejection speeds, the volumes of ejected liquid or the like before and after the replacement. If a suitable part of the recording head is made of transparent material, the replacement is not required.

Even if any suitable part cannot be replaced with another material, it is possible to determine which of the internal pressure and the external pressure is larger, without the replacement. This method will be described.

Figure 6D:
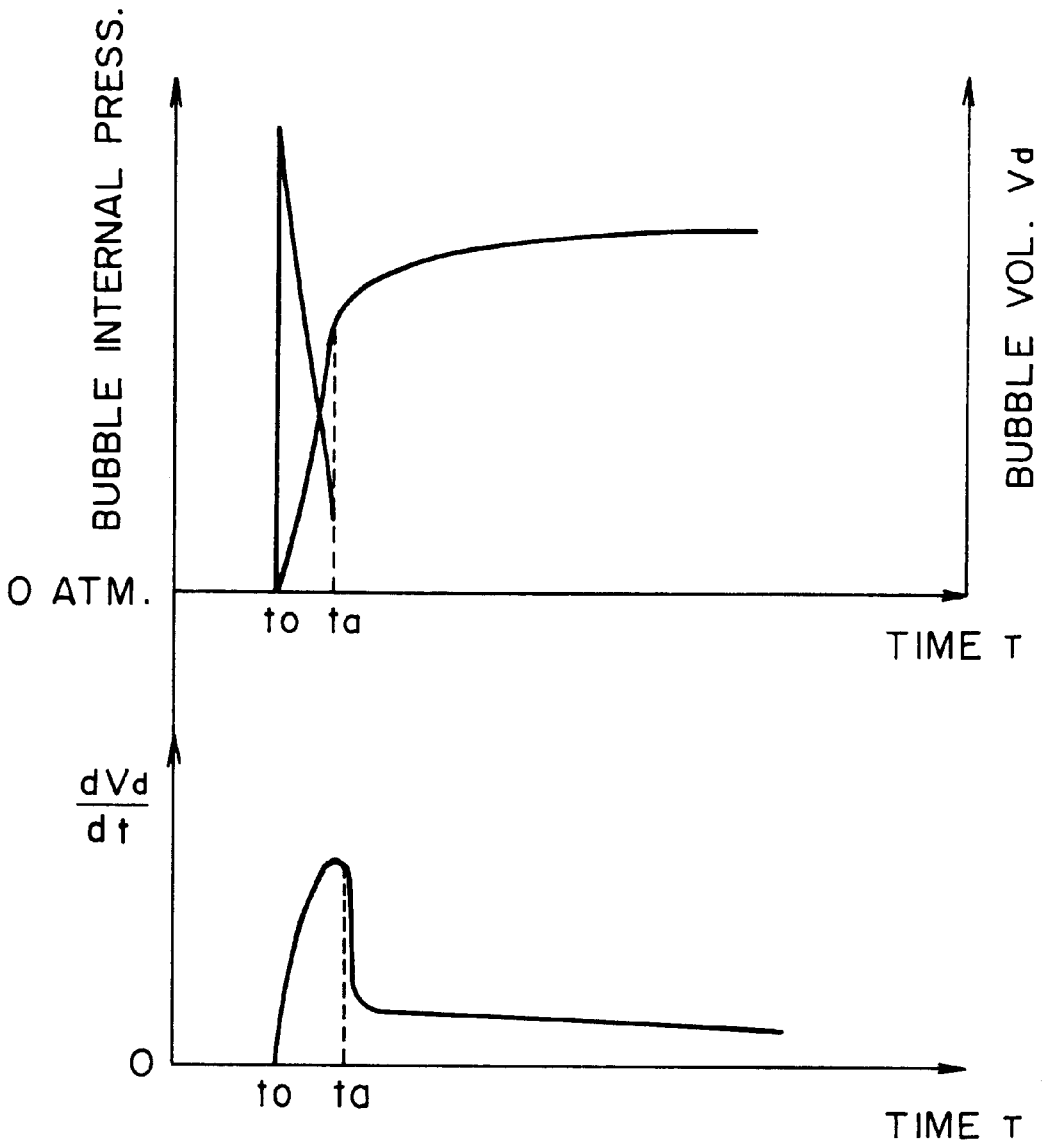
Figure 6E:
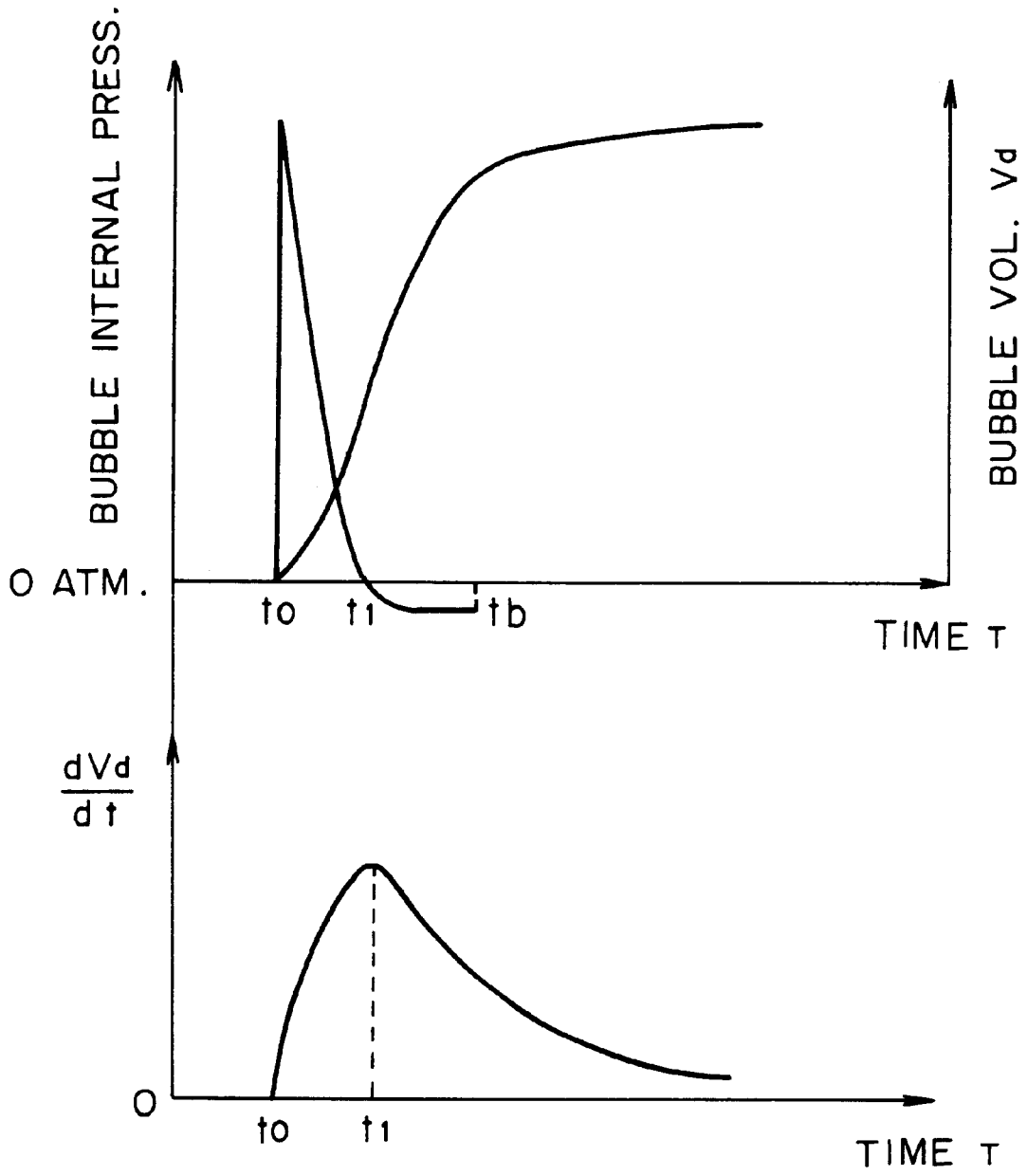

In another method, in the period from the start of the bubble creation to the ejection of the ink, the volume Vd of the ink is measured, and the second order differential $d^2Vd/dt^2$ is obtained. Then, the relation between the internal pressure and the external pressure can be determined. More specifically, if $d^2Vd/dt^2>0$, the internal pressure of the bubble is higher than the external pressure, and if $d^2Vd/dt^2 \leqq 0$, the internal pressure is equal to or less than the external pressure. FIG. 6D shows the change, with time, of the first order differential dVd/dt of the volume of the ejected ink when the bubble communication occurs with the internal pressure higher than the external pressure. From the start of the bubble creation ($t=t_0$) to the communication of the bubble with the ambience ($t=ta$), the internal pressure of the bubble is higher than the external pressure, and $d^2Vd/dt^2>0$. FIG. 6E shows the change, with time, of the first order differential dVd/dt of the volume of the ejected ink when the bubble communication occurs and the internal pressure is equal to or lower than the external pressure. From the start of the bubble creation ($t=t_0$) to the communication of the bubble with the ambience ($t=t_1$), the internal pressure of the bubble is higher than the external pressure, and $d^2Vd/dt^2=0$. However, in the period from $t=tp$ to $t=t_b$, the bubble internal pressure is equal to on lower than the external pressure, and $d^2Vd/dt^2 \leqq 0$.

Thus, on the basis of the second order differential $d^2Vd/dt^2$, it can be determined which is higher, the internal pressure or the external pressure.

The description will be made as to the measurement of the volume Vd of the ink outside the ejection outlet. The configuration of the droplet at any time after the ejection can be determined on the basis of observation, by a microscope, of the ejecting droplet while it is illuminated with a light source such as stroboscope, LED or laser. The pulse light is emitted to the recording head driven at regular intervals, with synchronization therewith and with a predetermined delay. By doing so, the configuration of the bubble as seen in one direction at the time which is the predetermined period after the ejection, is determined. The pulse width of the pulse-light is preferably as small as possible, provided that-the quantity of the light is sufficient for the observation, since then the configuration determination is accurate.

With this method, if the gas flow is observed in the external direction from the liquid passage at the instance when the bubble communicates with the ambience, it is understood that the communication occurs when the internal pressure of the bubble is higher than the ambient pressure.

If the gas flow into the liquid passage is observed, it is understood that the communication occurs when the bubble internal pressure is lower than the ambient pressure.

Figure 8A:
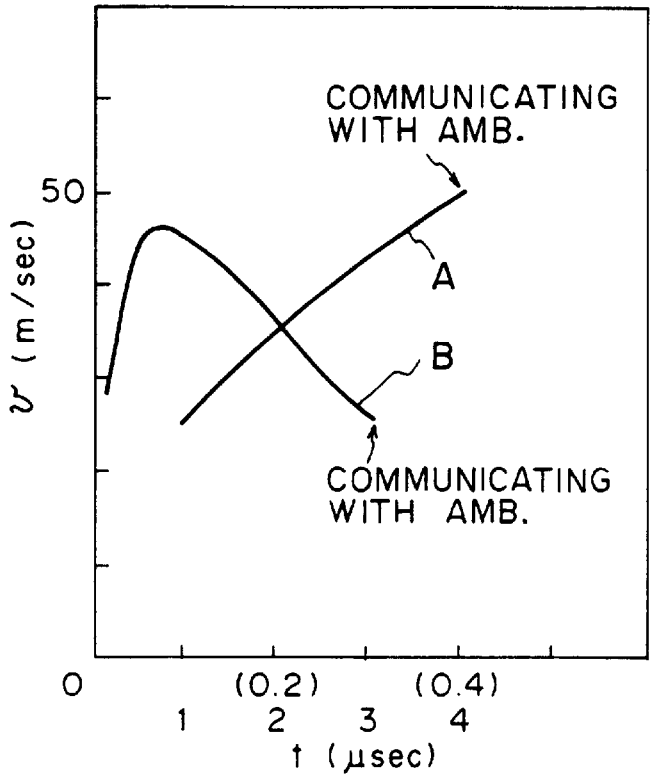
FIGS. 8A and 8B are graphs showing performance of a recording method and a recording apparatus according to a further specific embodiment of the present invention.
Figure 8B:
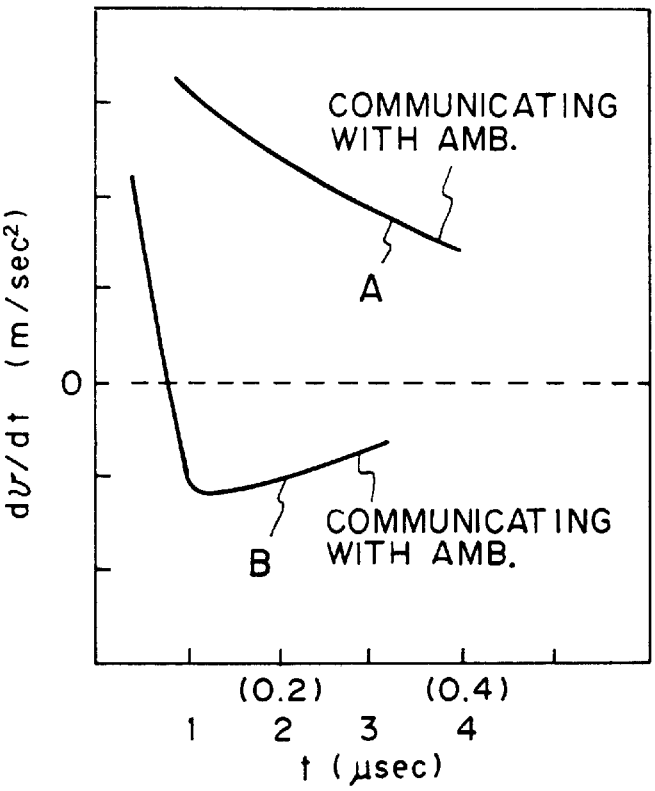

As for other preferable conditions, the bubble communicates with the ambience when the first order differentiation of the movement speed of an ejection outlet side end of the bubble is negative, as shown in FIGS. 8A and 8B and the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet. It is further preferable that both of the above conditions are satisfied when the bubble communicates with the ambience.

Referring to FIGS. 7A–7F there is shown the growth of the bubble in a liquid jet method and apparatus according to a second specific embodiment of the present invention.

The specific embodiment is summarized as follows:

(3) A recording method using a recording head including an ejection outlet for ejecting ink, a liquid passage communicating with the ejection outlet and an ejection energy generating means for generating thermal energy contributable to ejection of the ink by creation of a bubble in the liquid passage, wherein the bubble communicates with the ambience when $l_a/l_b \geqq 1$ is satisfied where la is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet.

(4) A recording apparatus including a recording head having an ejection outlet for ejecting ink, a liquid passage communicating with the ejection outlet and ejection energy generating means for generating thermal energy contributable to ejection of the ink by creation of a bubble in the liquid passage, a driving circuit for supplying a signal to said ejection energy generating means so that the bubble communicates with the ambience when $l_a/l_b \geqq 1$ is satisfied where $l_a$ is a distance between an ejection outlet side end of the ejection energy generating means and an ejection outlet side end of the bubble, and $l_b$ is a distance between that end of the ejection energy generating means which is remote from the ejection outlet and that end of the bubble which is remote from the ejection outlet, a platen for supporting a recording material for reception of the liquid ejected.

FIG. 7A shows the initial state in which the passage is filled with ink 3. The heater 2 (electro-thermal transducer, for example) is instantaneously supplied with electric current, the ink adjacent the heater 2 is abruptly heated by the pulse of the current in the form of the driving signal from the driving circuit, upon which a bubble 6 is produced on the heater 2 by the so-called film boiling, and the bubble abruptly expands (FIG. 7B). The bubble continues to expand toward the ejection outlet 5 (FIG. 7C), that is, in the direction of low intertia resistance. It further expands beyond the outlet 5 so that it communicates with the ambience (FIG. 7D). Here, the bubble 6 communicates with the ambience when $l_a/l_b \geqq 1$ is satisfied, where $l_a$ is a distance from an ejection outlet side end of the heater 2 functioning as the ejection energy generating means and an ejection outlet side end of the bubble 6, and $l_b$ is a distance from that end of the heater 2 remote from the ejection outlet and that end of the bubble 6 which is remote from the ejection outlet.

Figure 7F:
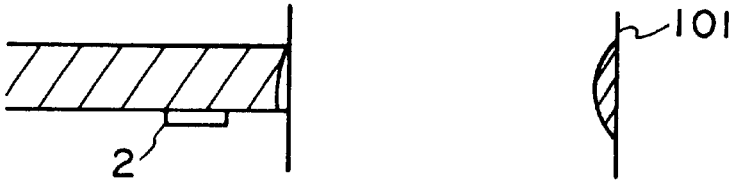

The ink 3 pushed out by the bubble through the outlet 5 moves forward further by the momentum given by the expansion of the bubble, until it becomes an independent droplet and is deposited on a recording material 101 such as paper (FIG. 7E). The cavity produced adjacent the outlet 5 is supplied with the ink from behind by the surface tension of the ink 3 and by the wetting with the member defining the liquid passage, thus restoring the initial state (FIG. 7F). The recording medium 101 is fed to the position faced to the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween. What is required is the relative movement therebetween to face the outlet to a desired position of the recording material.

If the liquid is ejected in accordance with the principle described above, the volume of the liquid ejected through the ejection outlet is constant at all times, since the bubble communicates with the ambience. When it is used for the recording, a high quality image can be produced without non-uniformity of the image density.

Since the bubble communicates with the ambience under the condition of $l_a/l_b \geqq 1$, the kinetic energy of the bubble can be efficiently transmitted to the ink, so that the ejection efficiency is improved.

Furthermore, when the liquid is ejected under the above-described conditions, the time required for the cavity produced adjacent to the ejection outlet after the liquid is ejected is filled with new ink, can be reduced as compared with the liquid (ink) is ejected under the condition of $l_a/l_b \geqq 1$, and therefore, the recording speed is further improved.

The description will be made as to the method of measuring the distances $l_a$ and $l_b$ when the bubble communicates with the ambience in the second specific embodiment. For example, in the case of the recording head shown in FIGS. 7A–7F, the top plate 4 is made of transparent glass plate. The recording head is illuminated from the above by a light source capable of pulsewise light emission such as stroboscope, laser or LED. The recording head is observed through microscope.

More particularly, the pulsewise light source is turned on and off in synchronism with the driving pulses applied to the heater, and the behavior from the creation of the bubble to the ejection of the liquid is observed, using the microscope and camera. Then, the distances $l_a$ and $l_b$ are determined.

The width of the liquid passage is substantially determined by the configuration of the used thermal energy generating element, but it is determined on the basis of rule of thumb. However, it has been found that the configuration of the liquid passage is significantly influential to growth of the bubble, and that it is an effective factor for the above condition of the thermal energy generating element in the passage in the second specific embodiment.

Using the height of the liquid passage, the growth of the bubble may be controlled so as to satisfy $l_a/l_b \geqq 1$, preferably $l_a/l_b \geqq 2$, and further preferably $l_a/l_b \geqq 4$. It has been found that the liquid passage height H is smaller than at least the liquid passage width W (H<W), since then the recording operation is less influenced by the ambient condition or another, and therefore, the operation is stabilized. This is because the communication between the bubble and the ambience occurs by the bubble having an increased growing speed in the interface at the ceiling of the liquid passage, so that the influence of the internal wall to the liquid ejection can be reduced, thus further stabilizing the ejection direction and speed. In the second specific embodiment, it has been found that H<0.8W is preferable since then the ejection performance does not change, and therefore, the ejection is stabilized even if the high speed ejection is effected for a long period of time.

Furthermore, by satisfying H<0.65W, a highly accurate deposition performance can be provided even if the recording ejection is quite largely changed by carrying different recording information.

It is further preferable in addition to the above conditions that the first order differential of the moving speed of the ejection outlet side end of the bubble is negative, when the bubble communicates with the ambience.

Referring to FIGS. 8A and 8B, there is shown the change, with time, of the internal pressure and the volume of the bubble in a liquid jet method and apparatus according to a third specific embodiment of the present invention. The third specific embodiment is summarized as follows:

(5) A liquid jet method using a recording head having an ejection outlet for ejecting ink, a liquid passage communicating with the ejection outlet and an ejection energy generating element for generating thermal energy contributable to the ejection of the ink by creation of a bubble in the liquid passage, wherein a first order differential of a movement speed of an ejection outlet side end of the created bubble is negative, when the bubble created by the ejection energy generating means communicates with the ambience through the ejection outlet.

(6) A liquid jet apparatus comprising a recording head having an ejection outlet for ejecting ink, a liquid passage communicating with the ejection outlet and an ejection energy generating element for generating thermal energy contributable to the ejection of the ink by creation of a bubble in the liquid passage, a driving circuit for supplying a signal to the ejection energy generating means so that a first order differential of a movement speed of an ejection outlet side end of the created bubble is negative, when the bubble created by the ejection energy generating means communicates with the ambience through the ejection outlet, and a platen for supporting a recording material for reception of the liquid ejected.

The third specific embodiment provides a solution to the problem solved by the first specific embodiment, by a different method. The major problem underlying this third specific embodiment is that the ink existing adjacent the communicating portion between the bubble and the ambience is over-accelerated with the result that the ink existing there is separated from the major part of the ink droplet. If this separation occurs, the ink adjacent thereto is splashed, or is scattered into mist.

In addition, where the ejection outlets are arranged at a high density, improper ejection will occur by the deposition of such ink. The third specific embodiment is based on the finding that the drawbacks are attributable to the acceleration.

More particularly, it has been found that the problems arise when the first order differential of the moving speed of the ejection outlet side end of the bubble is positive when the bubble communicates with the ambience.

FIGS. 8A and 8B are graphs of the first order differential and the second order differential (the first order differential of the moving speed) of the displacement of the ejection outlet side end of the bubble from the ejection outlet side end of the heater until the bubble communicates with the ambience. It will be understood that the above discussed problems arise in the case of a curve A in FIGS. 8A and 8B, where the first order differential of the moving speed of the ejection outlet side end of the bubble is positive.

Curves B in FIGS. 8A–and 8B represent the third specific embodiment using the concept of FIGS. 7A–7F. The created bubble communicates with the ambience under the condition that the first order differential of the moving speed of the ejection outlet side end of the bubble. By doing so, the volumes of the liquid droplets are stabilized, so that high quality images can be recorded without ink mist or splash and the resulting paper and apparatus contamination.

Additionally, since the kinetic energy of the bubble can be sufficiently transmitted to the ink, the ejection efficiency is improved so that the clogging of the nozzle can be avoided. The droplet ejection speed is increased, so that the ejection direction can be stabilized, and the required clearance between the recording head and the recording paper can be increased so that the designing of the apparatus is made easier.

The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording heads mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The description will be made as to the embodiments for the respective conditions.

Embodiment 1 for the First Condition

A recording head shown in FIG. 4 was produced with the following conditions:

Top plate 6: glass height and width of the liquid passage 12 of the recording head: 20 microns and 58 microns, respectively width and length of the heater 2: 28 microns and 18 microns Distance from the ejection outlet side edge of the heater to the ejection outlet: 20 microns Density of the liquid passages: 360 per inch Number of liquid passages 12: 48

Contents of the liquid:

C.I. Food Black 2: 3.0% by weight

Diethyleneglycol: 15.0% by weight

N-methyl-2-pyrrolidone: 5.0% by weight

Ion exchange water: 77.0% by weight

They are stirred in a container into a uniform mixture that is filtered with a Teflon filter having a diameter of 0.45 micron. The viscosity was 2.0 cps (20° C.). The ink was supplied into the liquid chamber 10 from the ink supply port 11.

Upon the driving of the heater 2 of the recording head, pulsewise electric signals were applied to the heater 2. The voltage of the pulse wave was 9.0 v, and the pulse width was 5.0 micro-sec. The frequency was 2 KHz.

The ejections of the ink through continuous 16 ejection outlets 5 were observed through a stroboscopic microscope. It was confirmed that the bubble created by the heating communicates with the ambience approximately 2 micro-sec after the start of bubble creation.

FIGS. 6A–6E show the changes, with time, of the volume Vd of the ink ejected through the ejection outlet and the first order differential dVd/dt of the volume Vd of the ink. The second order differential $d^2Vd/dt^2$ is negative in the period from 0.5 micro-sec after the start of the bubble creation to the communication of the bubble with the ambience approximately 2 micro-sec layer, and therefore, the internal pressure of the bubble is lower than the ambient pressure. This was confirmed with FIGS. 6A–6E.

It has been investigated from the bubble volume V as to which is higher the bubble internal pressure or the ambient pressure, and it was confirmed that $d^2V/dt^2 \leqq 0$ was satisfied, so that the bubble internal pressure is not higher than the ambient pressure.

The volume of the liquid was within the range of 14±1 p-liter for all of the ejection outlets 5. The speeds of the liquid droplets was uniformly about 14 m/sec, and the speed and the uniformity was satisfactory for good recording operation.

Then, the 16 heaters 2 were supplied with such electric signals as to provide a checker pattern by the respective picture elements. The desired checker pattern was printed on the recording paper without non-uniformity. The image was enlarged and observed, and it was confirmed that the image was free from scattering of the ink, and therefore, without the foggy background.

Embodiment 2 for the First Condition

The recording head shown in FIGS. 5A and 5B was used. The orifice plate 14 was made of transparent glass.

The ejection outlets 5 a circle having a diameter of 36 microns at the surface side of the orifice plate.

Distance from the heater surface to the ejection outlet: 20 microns

Size of the heater: 24×24 microns

Density of the ejection outlets: 360 per inch

Number of ejection outlets: 48

The same ink has in the embodiment 1 was supplied to the recording head.

The heating conditions for the heater 12 of the recording head was 7.0 V and 4.5 micro-sec at the frequency of 2 KHz.

The ejections from the continuous 16 ejection outlets 5 were observed by the stroboscopic microscope. It was confirmed that the bubble created by the heating communicates with the ambience approximately 2.1 micro-sec after the start of the bubble creation.

It was also confirmed that the second order differential $d^2V/dt^2$ of the volume of the bubble was negative in the period from 0.5 micro-sec after the start of the bubble creation to the communication of the bubble with the ambience approximately 2.1 micro-sec later, and therefore, the bubble internal pressure is lower than the ambient pressure.

The volumes of the droplets were measured, and were within the range of 18±1 p-liter for all the nozzles. The speed of the liquid droplet was approximately 10 m/sec.

Similarly to Embodiment 1, the 16 heaters 2 were supplied with electric signals for formation of the checker pattern by the respective picture elements. A desired checker pattern was formed on the recording paper without non-uniformity. The checker pattern image was enlarged and observed, and it was confirmed that the image was free from the scattering of the ink and the background fog.

Embodiment 3 for the First Condition

The same recording head as in Embodiment 1 was used. The contents of the liquid were:

C.I. Direct Black 154: 3.5% by weight

Glycerin: 5.0% by weight

Diethylene glycol: 25.0% by weight

Polyethylene glycol: 28.0% by weight (average molecular weight was 300)

Ion exchange water: 38.5% by weight

They were stirred in a container into a uniform mixture and was filtered with a Teflon filter having a diameter of 0.45 micron. The viscosity was 10.5 cps (20° C.). The other conditions were the same as in Embodiment 1.

It was confirmed that the bubble communicates with the ambience under the condition that the bubble internal pressure is lower than the ambient pressure. The ink ejection speed was lower than that of Embodiment 1 and was 7 m/sec. However, the ejections were very stable.

Embodiments 4–12 for the First Condition

The recording head used had bent liquid passages similarly to the recording head used in Embodiment 2. The ink used was the same as in Embodiment 2.

Table 1 shows the results of ejection of the respective recording heads. The structures of the recording heads are shown in FIGS. 9A–17C.

As will be understood from Table 1, the volume and the ejection speed of the liquid droplets were very stable, and the resultant records were very good.

TABLE 1

| EMB. | OUTLET (μm) | OUTLET SHAPE | HTR (μm) | DIS. L (μm) | HTR POSITION | | DRIVE CONDITION VOLT (v) | W (μs) | F (kHZ) | DROPLET VOL. (pl) | V. (m/s) | FIG. |
|---|---|---|---|---|---|---|---|---|---|---|---|---|
| 4 | 30 × 30 | SQUARE | 25 × 25 | 25 | ALIGNED WITH OUTLET | | 12.0 | 5.0 | 1 | 20 ± 1 | 7 | 9 |
| 5 | 30 × 30 | " | 25 × 13 | 20 | DEVIATED | | 12.0 | 5.5 | 2 | 13 ± 1 | 5 | 10 |
| 6 | 30 × 30 | " | 25 × 13 | 20 | " | | 12.0 | 5.5 | 2 | 12 ± 1 | 5 | 11 |
| 7 | 20 × 20 | " | 20 × 20 | 40 | NON-FACED TO OUTLET | | 9.0 | 5.0 | 1 | 12 ± 1 | 6 | 12 |
| 8 | 20 × 20 | " | 20 × 20 | 40 | NON-FACED TO OUTLET | ×2 | 9.0 | 5.0 | 500 Hz | 14 ± 1 | 8 | 13 |
| 9 | 25 × 25 | " | 25 × 20 | 40 | NON-FACED TO OUTLET | ×3 | 12.0 | 4.5 | 1 | 24 ± 1 | 10 | 14 |
| 10 | 30 × 30 | " | 30 × 30<br>30 × 15 | 30 | ALIGNED BUT NOT FACED | | 14.0 | 4.5 | 1 | 25 ± 1 | 8 | 15 |
| 11 | 30 × 30 | " | 30 × 30<br>30 × 15 | 30 | ALIGNED BUT NOT FACED | ×3 | 14.0 | 4.0 | 1 | 26 ± 1 | 10 | 16 |
| 12 | 50ø | CIRCLE | 40 × 40 | 30 | ALIGNED WITH OUTLET | | 18.0 | 5.0 | 1 | 55 ± 1 | 7 | 17 |

Referring to FIGS. 9A–17C, the structures of the recording heads will be described. Each of these Figures include a top plan view, a sectional view taken along a first section line and a cross-section taken along a second section line to illustrate the configuration and position of the heat generating resistor 2. The ejection outlets 5 have the same configuration as the cross-section of the passage from the heater 2 to the ejection outlet. However, as will be understood from FIG. 1B, the configuration may be properly selected.

In FIGS. 9A and 9B(1)–9B(3), the heat generating resistor 2 is disposed on the base plate and is smaller than the cross-sectional area of the ejection passage. With this structure, the liquid passage is not blocked so that the action illustrated in FIG. 1B is further stabilized.

Figure 10A:
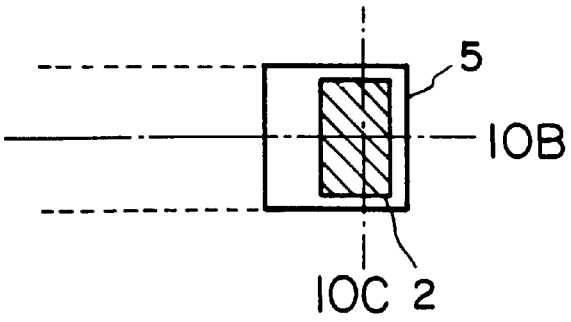
Figure 10B:
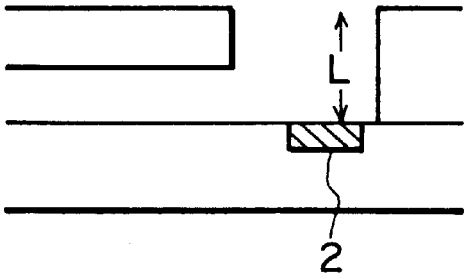
Figure 10C:
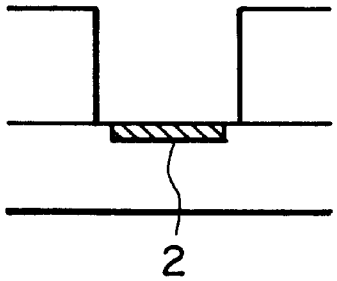

In FIGS. 10A–10C, the center of the heat generating resistor 2 is deviated toward the end wall of the liquid passage. The area of the resistor 2 is approximately one half that of FIGS. 9A–9B(3). In FIGS. 10A–10C, the area at which the bubble communicates with the ambience is shifted to the end wall side.

Figure 12A:
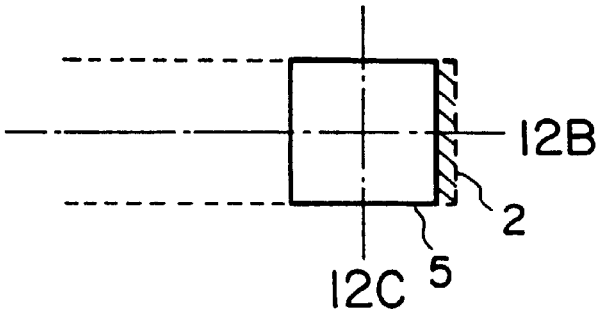
Figure 12B:
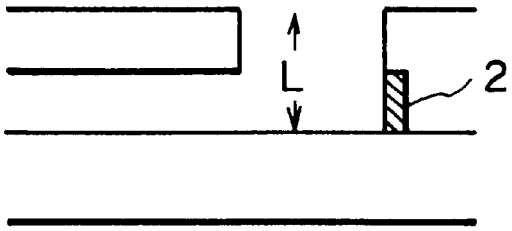
Figure 12C:
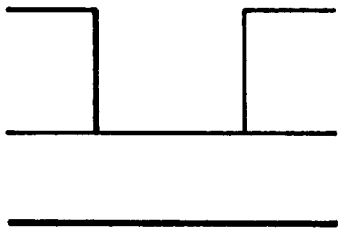
Figure 13A:
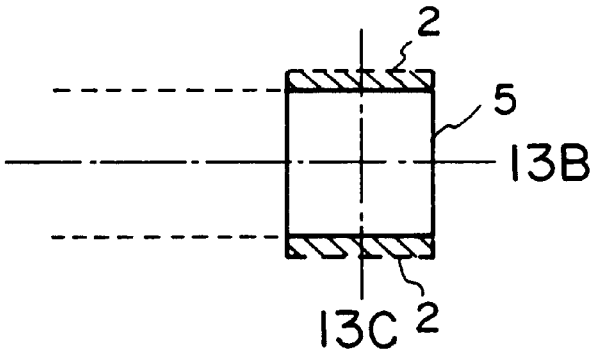
Figure 13B:
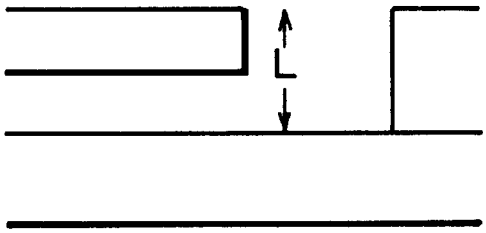
Figure 13C:
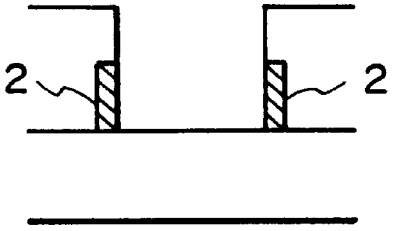
Figure 14A:
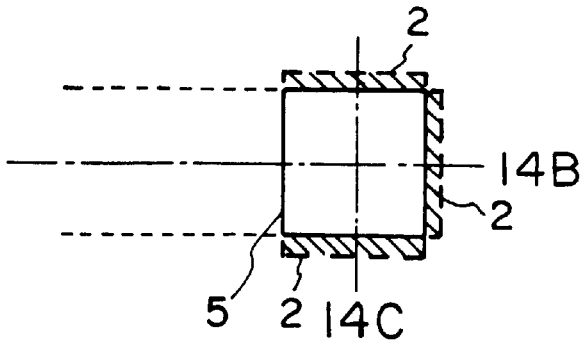
Figure 14B:
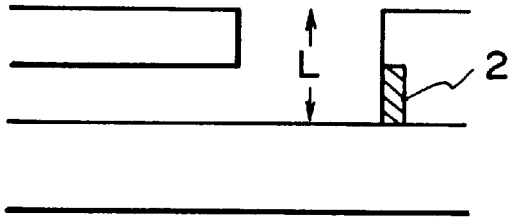
Figure 14C:
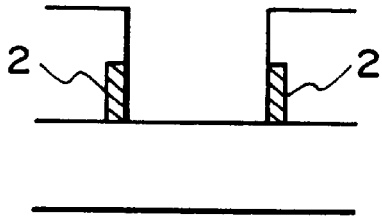

In FIGS. 14A–14C, the structure is a combination of the FIGS. 13A–13C structure and the FIGS. 12A–12C, structure, as will be understood from the Figure. The number of bubble creating sources is 3.

Figure 15A:
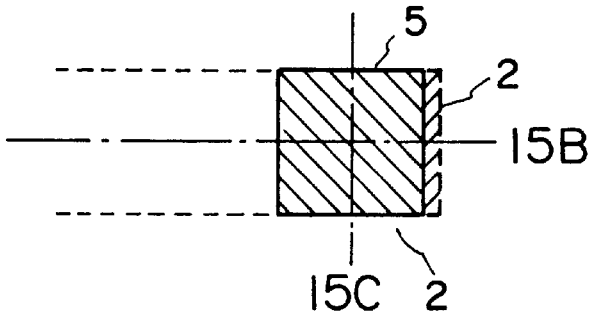
Figure 15B:
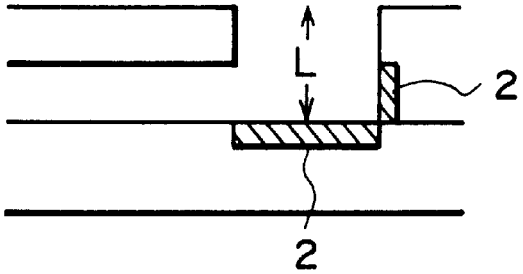
Figure 15C:
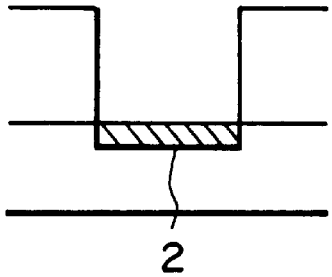

FIGS. 15A–15C show the structure which is a combination of the FIG. 1B structure and FIGS. 12A–12C structure.

Figure 16A:
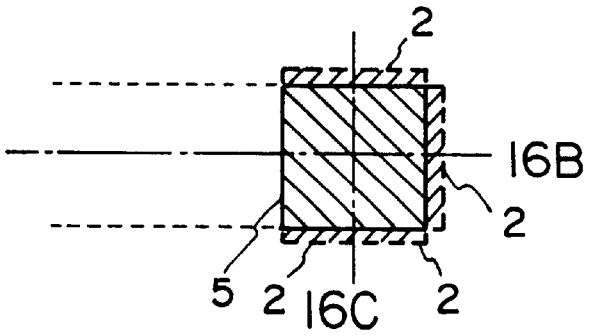
Figure 16B:
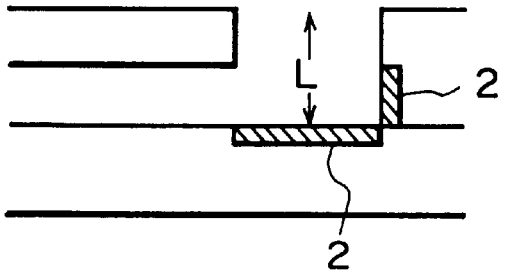
Figure 16C:
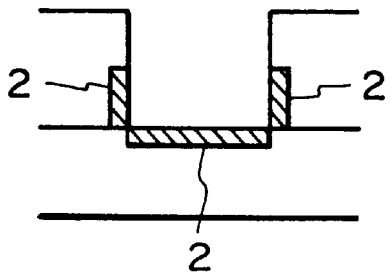

FIGS. 16A–16C show the structure which is a combination of the FIGS. 15A–15C structure and the FIGS. 13A–13C structure.

Figure 17A:
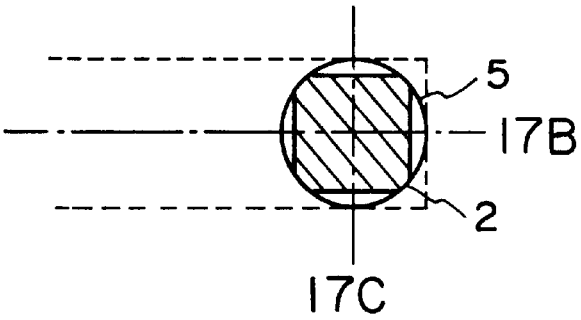
Figure 17B:
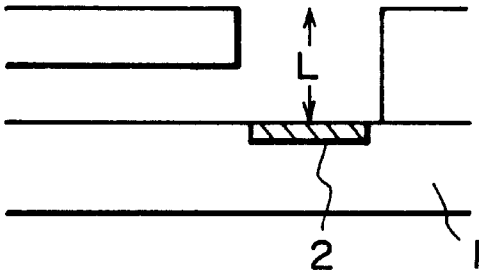
Figure 17C:
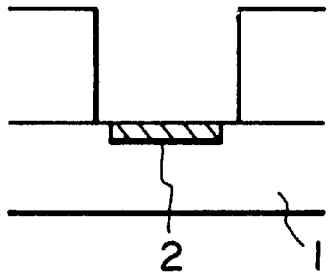

In FIGS. 17A–17C, the ejection outlet 5 is circular, and the heat generating resistor 2 is similar to that of FIGS. 9A–9B(3).

Embodiments 13–15 for the First Condition

The recording heads used had straight liquid passages as in the recording head of Embodiment 1. The ink used was the same as in Embodiment 1.

Table 2 shows the result of ejections for the recording heads. FIGS. 18A–20C show the structure of the recording heads.

As will be understood from Table 2, the volume of the ejected liquid and the ejection speed of the droplet were very stable in all of the cases, and the records were very good.

TABLE 2

| EMB. | OUTLET W × H (μm) | OUTLET SHAPE | HTR W × L (μm) | DIS. L (μm) | DRIVE CONDITION VOLT (V) | W (μs) | F (kHz) | DROPLET VOL. (pl) | V. (m/s) | FIG. |
|---|---|---|---|---|---|---|---|---|---|---|
| 13 | 40 × 30 | SQUARE | 30 × 30 | 30 | 14.0 | 4.0 | 2 | 34 ± 1 | 15 | 18 |
| 14 | 40 × 30 | " | 30 × 20 | 40 | 12.0 | 5.0 | 1 | 41 ± 1 | 11 | 19 |
| 15 | 30 × 30 (passage; 40 × 40) | " | 30 × 30 | 30 | 12.0 | 5.0 | 1 | 28 ± 1 | 8 | 20 |

Figure 11A:
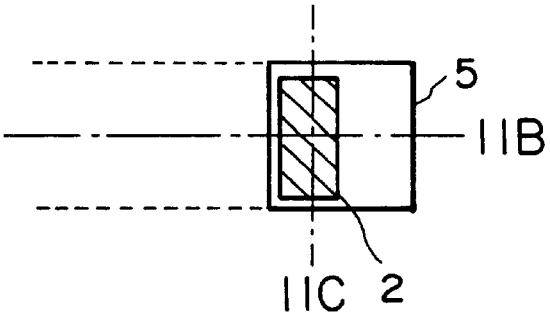
Figure 11B:
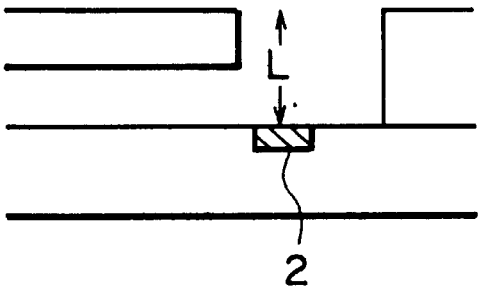
Figure 11C:
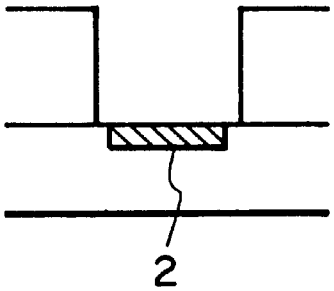

FIGS. 11A–11C have the structure wherein the heat generating resistor 2 is deviated in the other way.

In FIGS. 12A–12C the heat generating resistor 2 is provided on the above-described end wall, in which the droplet has the configuration which is a mixture of FIG. 1A and FIG. 1B configurations. This structure is advantageous in the good refilling performance.

In FIGS. 13A–13C, the heat generating resistors 2 are provided on the opposite lateral walls. A high ejection speed can be provided by the unification of the two bubbles provided by the respective heat generating resistors 2.

The structures of FIGS. 18A, 18B(1)–18B(3), 19A and 19B, and 20A–20C are modifications of the structure of FIG. 1A.

In FIGS. 18A and 18B(1)–18B(3), an additional heat generating resistor 2 is provided at a side facing the base plate, in addition to the heat generating resistor 2 on the base plate in the liquid passage. They are simultaneously driven, by which the center of the ejection can be shifted to the center of the ejection outlet. By doing so, the ejection becomes similar to that of FIG. 1B.

Figure 19A:
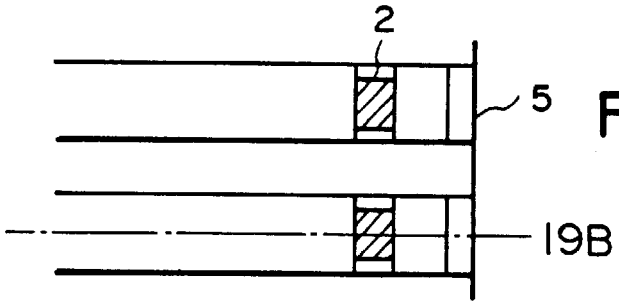
Figure 19B:
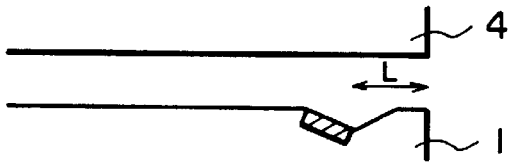
Figure 20A:
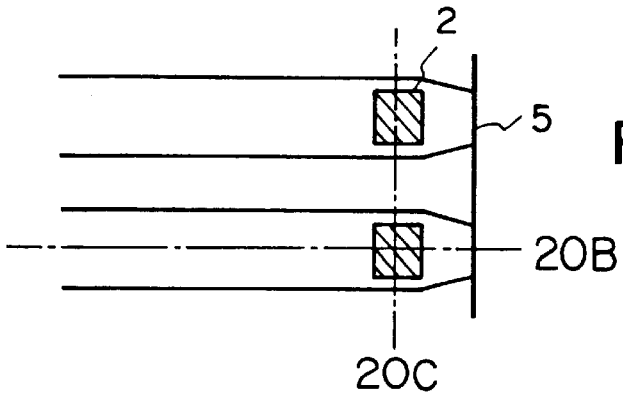
Figure 20B:
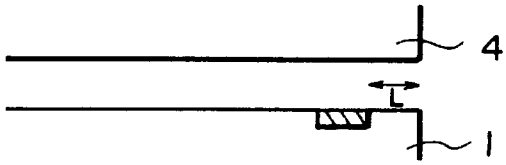
Figure 20C:
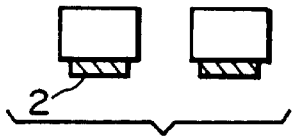

FIGS. 19A and 19B show a structure which has the advantages of FIG. 1A and FIG. 1B structures, so that a tail of the liquid droplet can be shifted to the center of the ejection. In FIGS. 20A–20C, the ejection outlet of FIG. 1A is converged in the ejection direction.

In all of these embodiments, the bubble communicates with the ambience under the condition that the internal pressure of the bubble is lower than the external pressure, so that the gas in the bubble is prevented from exploding. As a result, the background fog on the recording paper or the contamination of the inside of the apparatus attributable to the mist or splash of the ink can be prevented.

In addition, the kinetic energy of the bubble can be sufficiently transmitted to the ink, and therefore, the ejection efficiency is improved.

The description will be made as to the embodiments for the third condition.

Embodiment 1 for the Third Condition

In this embodiment, the recording head shown in FIGS. 4A and 4B were used with the following conditions:

Top plate 4: glass

Height, width and length of the liquid passage 12: 25 microns, 35 microns and 195 microns Width and length of the heater: 30 microns and 25 microns Distance from the ejection outlet side edge of the heater to the ejection outlet: 20 microns Density of the liquid passages and ejection outlets: 360 per inch Number of ejection outlets: 48

The contents of the liquid were as follows:

C.I. Food Black 2: 3.0% by weight

Diethylene glycol: 15.0% by weight

N-methyl-2-pyrrolidone: 5.0% by weight

Ion exchange water: 77.0% by weight

They were stirred in a container into a uniform mixture and were filtered with a Teflon filter having an aperture diameter of 0.45 micron. The viscosity of the liquid was 2.0 cps (20° C.). The ink was supplied into the liquid chamber 10 through the ink inlet port 11.

The heating conditions by the heater 2 were 9.0 V and 5.0 micro-sec at the frequency of 4 KHz.

Figure 21:
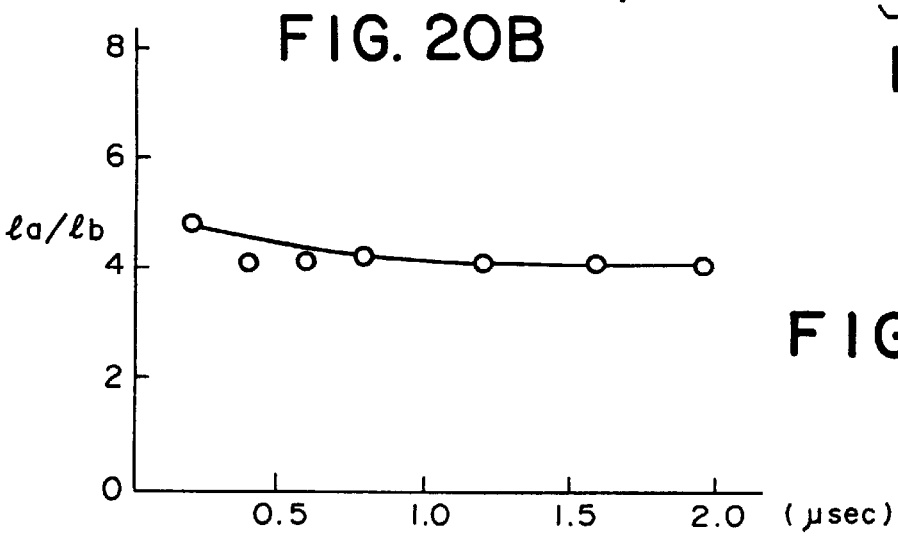
FIG. 21 is a graph of the change of a ratio $l_a/l_b$ (front and back sides of the bubble).

The ink ejections through the consecutive 16 nozzles were observed using a pulse light source and a microscope. It was confirmed that the bubble communicates with the ambience approximately 2.0 micro-sec after the start of the bubble creation. In addition, $l_a/l_b$ was measured from the start of the bubble creation to the communication of the bubble with the ambience. FIG. 21 shows the results in the form of a graph of $l_a/l_b$ vs. time.

As will be understood from FIG. 21, when the bubble communicates with the ambience, the condition $l_a/l_b \geqq 1$ was satisfied. The independent droplets ejected from the ejection outlets were 15±1 p-liter. The ejection speed of the droplet was approximately 11 m/sec.

The 16 heaters 2 were supplied with such electric signals as to provide a checker pattern by the respective picture elements. It was confirmed that a desired checker pattern was formed on the recording paper without non-uniformity of the print. The image was enlarged and observed, and it was confirmed that the image was free from the ink scattering and the background fog.

Embodiment 2 for the Third Condition

The recording head used in Embodiment 1 for he third condition (FIGS. 4A and 4B) was used. The contents of the liquid were:

C.I. Direct Black 154: 3.5% by weight

Glycerin: 5.0% by weight

Diethylene glycol: 25.0% by weight

Polyethylene glycol: 28.0% by weight (average molecular weight was 300)

Ion exchange water: 38.5% by weight

They were stirred in a container into a uniform mixture and were filtered with a Teflon filter having an aperture diameter of 0.45 micron. The viscosity was 10.5 cps (20° C.). The ink was supplied and ejected.

As a result, it was confirmed that the ejection speed is lower than in Embodiment 1, more particularly, 7.5 msec. However, the ejections were very stable.

Since the third condition is satisfied, that is, since the bubble communicates with the ambience when $l_a/l_b \geqq 1$ is satisfied, where $l_a$ is a distance from an ejection outlet side end of the heater and an ejection outlet side end of the bubble, and $l_b$ is a distance from that end of the heater remote from the ejection outlet and that end of the bubble remote from the ejection outlet, the kinetic energy of the bubble can be sufficiently transmitted to the ink, and therefore, the ejection efficiency is increased, by which the contamination of the background on the recording paper and the contamination of the inside of the apparatus due to the mist and/or the splash can be prevented, and in addition, the clogging of the nozzles can be prevented.

Furthermore, the time required for the cavity adjacent the ejection outlet after the ejection of the liquid droplet to be filled with the new ink can be reduced, so that the speed of the recording is further increased.

Because the ejection speed is increased, the direction of the droplet ejection is stabilized, so that the distance between the recording head and the recording paper may be increased, thus making the designing of the recording head easier.

As described hereinbefore, the second condition is that the first order differential of the movement speed of the ejection side end of the bubble is negative (the acceleration speed is not positive), the ink adjacent to the communicating part is not imparted with an extremely high acceleration, and therefore, the ink adjacent the communicating part is not splashed or pulverized into mist, but the ink is unified with the main droplet, and therefore, the background contamination of the record and the contamination of the inside of the apparatus can be prevented.

Because of the communication of the bubble with the ambience under the condition that the moving speed of the ejection outlet side end of the bubble is negative, the kinetic energy of the bubble can be sufficiently transferred to the ink, and therefore, the ejection efficiency is improved. In addition, since the bubble communicates with the ambience after the bubble volume is increased, almost all of the ink adjacent to the ejection outlet is able to communicate with the ambience, so that the ejection volume can be stabilized. In addition, the ink does not remain adjacent the ejection outlet, and therefore, the possible ejection failure attributable to the introduction of the air into the ink in the liquid passage, can be avoided.

The description will be made as to the method of determining the moving speed of the ejection outlet side end of the bubble and the first order differential of the moving speed.

The position of the ejection outlet side end of the bubble at the respective times after the start of the bubble creation can be observed by a microscope wherein the bubble is illuminated from the top or side with pulse light such as stroboscope (LED) or laser. More particularly, as shown in FIGS. 22A(1)–22A(10) and 22B(1)–22B(4), wherein the ejection process is shown, the change, with time, of the displacement $x_{b-h}$ of the ejection outlet side end of the bubble from the ejection side end of the heater from the start of the bubble creation to the communication of the bubble with the ambience is evident. On the basis of the measurements, a first order differential $dx_{b-h}/dt$ of the displacement is obtained, by which the moving speed vx of the ejection outlet side end of the bubble is obtained. Then, the first order differential dvx/dt of the moving speed (the second order differential $d^2x_{b-h}/d^2t$ of the displacement) can be obtained.

Here, it is required that the bubble can be observed directly or indirectly from the outside. In order to permit observance of the bubble externally, a part of the recording head is made of transparent material. Then, the creation, development or the like of the bubble is observed from the outside. If the recording head is of non-transparent material, a top plate or the like of the recording head may be replaced with a transparent plate. For the better replacement from the standpoint of equivalency, the hardness, elasticity and the like are preferably as close as possible with each other.

If the plate of the recording head is made of metal, non-transparent ceramic material or colored ceramic material, it may be replaced with transparent plastic resin material (transparent acrylic resin material) plate, glass plate or the like. The part of recording head to be replaced and the material to replace are not limited to that described above.

In order to avoid difference in the -nature of the bubble formation or the like due to the difference in the nature of the materials, the material to replace preferably has the wetting nature relative to the ink or another nature which is as close as possible to that of the material replaced. Whether the bubble creation is the same or not may be confirmed by comparing the ejection speeds, the volumes of the ejected liquid or the like before and after the replacement. If a suitable part of the recording head is made of transparent material, the replacement is not required.

The embodiments for the second condition will be described.

Embodiment 1 for the Second Condition

In these embodiments, the recording head as shown in FIGS. 4A and 4B was used with the following conditions:

Top plate: glass

Height and width of the liquid passage 12: 25 microns and 35 microns

Width and length of the heater: 30 microns and 25 microns

A distance from the ejection outlet side end of the heater to the ejection outlet: 25 microns Density of the liquid passages and ejection outlets: 360 per inch Number of ejection outlets: 48

The contents of the ink were as follows:

C.I. Food Black 2: 3.0% by weight

Diethylene glycol: 15.0% by weight

N-methyl-2-pyrrolidone: 5.0% by weight

Ion exchange water: 77.0% by weight

They were stirred in a container into a uniform mixture and were filtered with a Teflon filter having an aperture diameter of 0.45 micron. The viscosity of the ink was 2.0 cps (20° C.). The ink was supplied into the liquid chamber 10 through an ink supply port 11.

The heating conditions of the heater 2 of the recording head were 9.0 V and 5 micro-sec at the frequency of 2 KHz.

The ejections of the ink through consecutive 16 nozzles were observed by a microscope using a pulse light source. It was confirmed that the bubble communicates with the ambience approximately 2 micro-sec after the start of the bubble creation. The displacement of the ejection outlet side end of the bubble from the ejection outlet side end of the heater was measured from the start of the bubble creation to the communication of the bubble with the ambience, and it was confirmed that the first order differential of the moving speed of the ejection outlet side end of the bubble is negative.

The volume of the ejected liquid droplet was 18±1 p-liter for each of the nozzles. The speed of the droplet was approximately 9 m/sec.

The 16 heaters 2 were supplied with such electric signals as to provide a checker pattern by respective picture elements. A desired checker pattern was uniformly formed on the recording paper. The image was enlarged and observed, and it was confirmed that the ink scattering and the background fog were smaller than the conventional head.

Embodiment 2 for the Second Condition

The recording head shown in FIGS. 5A and 5B was used in this embodiment with the following conditions:

Ejection outlet circle of diameter: 32 microns

Heater size: 22×22 microns

Distance from the heater surface to the ejection outlet: 25 microns

Density of the liquid passages and ejection outlets: 360 per inch

Number of ejection outlets: 48

The same ink as in Embodiment 1 for the second condition was used.

The heating conditions by the heater 2 of the recording head were 9.0 V and 5 micro-sec at the frequency of 2 KHz.

The ejections through the consecutive 16 nozzles were observed using a microscope and a pulse light source. It was confirmed that the bubble communicates with the ambience approximately after 3 micro-sec from the start of bubble creation. The displacement of the outlet side end of the bubble from the outlet side end of the heater was measured from the start of the bubble creation and the communication of the bubble with the ambience. It was confirmed that the first order differential of the moving speed of the outlet side end of the bubble is negative. The volume of the independent droplet was 17±1 p-liter for each of the nozzles. The speed of the droplet was approximately 7 m/sec.

The 16 heaters 2 were supplied with such electric signals as to provide a checker pattern by the respective picture elements. It was confirmed that a desired checker pattern was formed on the recording paper without non-uniformity of the print. The image was enlarged and observed, and it was confirmed that the image was free from the ink scattering and the background fog.

Embodiment 3 for the Second Condition

The recording head used in this embodiment was the same as the recording head used in Embodiment 1 for the second condition (FIGS. 4A and 4B).

The contents of the ink were as follows:

C.I. Direct Black 154: 3.5% by weight

Glycerin: 5.0% by weight

Diethylene glycol: 25.0% by weight

Polyethylene glycol: 28.0% by weight (average molecular weight was 300)

Ion exchange water: 38.5% by weight

They were stirred in a container into a uniform mixture and was filtered with a Teflon filter having an aperture diameter of 0.45 micron. The viscosity was 10.5 cps (20° C.). As a result, the ejection speed was lower than that of Embodiment 1 for the second condition, and was 6 m/sec. However, it was confirmed that the ejections were stable.

By communicating the bubble with the ambience under the second condition, that is the first order differential of the moving speed of the outlet side end of the bubble is negative, the contamination of the background of the record and the contamination of the inside of the apparatus attributable to the ink mist or the splash can be prevented with further certainty.

In addition, the kinetic energy of the bubble can be sufficiently transmitted to the ink, and therefore, the ejection efficiency is improved. In addition, the clogging of the liquid passage can be prevented. In addition, the ejection speed of the liquid droplet is increased, so that the direction of the ejection of the droplet can be stabilized. This permits increase of the distance between the recording head and the recording paper, so that the designing of the apparatus is made easier.

As described in the foregoing, according to the present invention, the ambience communication type recording head or apparatus is made practical in the field of the recording apparatus industries. In the foregoing embodiments, the heat generating resistor has been used, the present invention is applicable to the system in which the film boiling is produced by the light energy or to a system wherein the film boiling is produced by a converter which converts light energy or electromagnetic wave to thermal energy.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection method for ejecting liquid through an ejection outlet which is in fluid communication with a liquid passage, said method comprising the steps of:

creating a bubble through film boiling by application of thermal energy to the liquid in the liquid passage, by which a volume of the bubble increases and then decreases; and ejecting the liquid through the ejection outlet, while the bubble is in fluid communication with ambience during decreasing of the volume of the bubble.

2. A liquid ejection method according to claim 1, wherein the liquid passage is provided with a heat generating resistor for generating the thermal energy.

3. A liquid ejection method according to claim 2, wherein the heat generating resistor is provided opposed to the ejection outlet in the liquid passage.

4. A liquid ejection method according to claim 1, wherein the liquid is ink.

5. A liquid ejection method according to claim 1, wherein the liquid passage is not blocked by the bubble.

6. A liquid ejection method according to claim 1, wherein a droplet of the liquid is ejected in said ejecting step.

7. A liquid ejection method for ejecting liquid through an ejection outlet which is in fluid communication with a liquid passage; said method comprising the steps of:

creating a bubble through film boiling by application of thermal energy to the liquid in the liquid passage, by which a volume of the bubble increases; and ejecting the liquid through the ejection outlet, while the bubble is in fluid communication with ambience and an internal pressure of the bubble is negative relative to ambient pressure.

8. A liquid ejection method according to claim 7, wherein the liquid passage is provided with a heat generating resistor for generating the thermal energy.

9. A liquid ejection method according to claim 8, wherein the heat generating resistor is provided opposed to the ejection outlet in the liquid passage.

10. A liquid ejection method according to claim 7, wherein the liquid is ink.

11. A liquid ejection method according to claim 7, wherein the liquid passage is not blocked by the bubble.

12. A liquid ejection method according to claim 7, wherein a droplet of the liquid is ejected in said ejecting step.

13. A liquid ejection apparatus for ejecting liquid from an ejection outlet in fluid communication with a liquid passage, said apparatus comprising:

a liquid ejection head having said liquid passage in fluid communication with said ejection outlet to eject the liquid therethrough;

ejection energy generating means for heating the liquid in said liquid passage to create a bubble which is effective to eject the liquid from said ejection outlet; and a driving circuit for supplying, to said ejection energy generating means, a signal for said energy generating means to create a bubble through film boiling, by which a volume of the bubble increases and then decreases, wherein said liquid ejection head ejects the liquid through the ejection outlet, while the bubble is in fluid communication with the ambience during decreasing of the volume of the bubble.

14. An apparatus according to claim 13, wherein said ejection energy generating means comprises a heat generating resistor for generating thermal energy.

15. An apparatus according to claim 13, wherein the liquid is ink.

16. An apparatus according to claim 13, wherein said liquid ejection head ejects a droplet of liquid.

17. A liquid ejection apparatus for ejecting liquid from an ejection outlet in fluid communication with a liquid passage, said apparatus comprising:

a liquid ejection head having said liquid passage in fluid communication with said ejection outlet to eject the liquid therethrough;

ejection energy generating means for heating the liquid in said liquid passage to create a bubble which is effective to eject the liquid from said ejection outlet; and a driving circuit for supplying, to said ejection energy generating means, a signal for said energy generating means to create a bubble and to grow the bubble to a neighborhood of said ejection outlet, by film boiling of the liquid, wherein said liquid ejection head ejects the liquid through the ejection outlet, while the grown bubble is in fluid communication with ambience with an internal pressure of the bubble being lower than ambient pressure.

18. An apparatus according to claim 17, wherein said ejection energy generating means comprises a heat generating resistor for generating thermal energy.

19. An apparatus according to claim 18, wherein the heat generating resistor is provided opposed to the ejection outlet in the liquid passage.

20. An apparatus according to claim 17, wherein the liquid is ink.

21. An apparatus according to claim 17, wherein said liquid ejection head ejects a droplet of liquid.

22. A liquid ejection head comprising:

a liquid passage;

an ejection outlet in fluid communication with said liquid passage; and ejection energy generating means for creating a bubble through film boiling by application of thermal energy to liquid in said liquid passage, by which a volume of the bubble increases and then decreases, and for ejecting the liquid through said ejection outlet, while the bubble is in fluid communication with ambience during decreasing of the volume of the bubble.

23. A liquid ejection heading according to claim 22, wherein a droplet of the liquid is ejected through said ejection outlet.

24. A liquid ejection head according to claim 22, wherein the liquid is ink.

25. A liquid ejection head according to claim 22, wherein said ejection energy generating means comprises a heat generating resistor in said liquid passage for generating the thermal energy.

26. A liquid ejection head according to claim 25, wherein said heat generating resistor is provided opposed to said ejection outlet in said liquid passage.

27. A liquid ejection head comprising:

a liquid passage;

an ejection outlet in fluid communication with said liquid passage; and ejection energy generating means for creating a bubble through film boiling by application of thermal energy to liquid in said liquid passage, by which a volume of the bubble increases, and for ejecting the liquid through the ejection outlet, while the bubble is in fluid communication with ambience and an internal pressure of the bubble is negative relative to ambient pressure.

28. A liquid ejection head according to claim 27, wherein a droplet of the liquid is ejected through said ejection outlet.

29. A liquid ejection head according to claim 27, wherein the liquid is ink.

30. A liquid ejection head according to claim 27, wherein said ejection energy generating means comprises a heat generating resistor in said liquid passage for generating the thermal energy.

31. A liquid ejection head according to claim 30, wherein said heat generating resistor is provided opposed to said ejection outlet in said liquid passage.

* * * * *

UNITED STATES PATENT AND TRADEMARK OFFICE

CERTIFICATE OF CORRECTION

PATENT NO. : 6,488,364 B1
DATED : December 3, 2002
INVENTOR(S) : Nakajima et al.

It is certified that error appears in the above-identified patent and that said Letters Patent is hereby corrected as shown below:

Column 1,
Line 51, “20” should be deleted.
Line 59, “most,” should read -- most --.

Column 2,
Line 12, “growth” should read -- grows --.
Line 17, “stabilized in” should read -- stabilized. In --.
Line 44, “a on-demand” should read -- an on-demand --.

Column 4,
Line 3, “20A-20B and 20C” should read -- and 20A-20C --.
Line 16, “shows” should read --show --.
Line 21, “layer” should read -- layer 2 --.
Line 22, “a unshown” should read -- an unshown --.
Line 23, “electrodes” should read -- electrode --.
Line 53, “crossection” should read -- cross-section --.
Line 61, “opening” should read -- opening 5 --.

Column 5,
Line 30, “instable” should read -- unstable --.

Column 6,
Line 1, “configurations” should read -- configuration --.
Line 6, “he” should read -- the --.
Line 36, “form.” should read -- form --.
Line 42, “larger” should read -- larger, --.

Column 7,
Line 8, “communicates.” should read -- communicate. --.
Line 22, “prior” should be deleted.
Line 23, “recording” should read -- prior recording --.
Line 59, “record” should read -- recording --.

Column 9,
Line 54, “$\leq$.” should read -- $\leq$0. --.

Column 10,
Line 6, “to the” should read -- to that --.
Line 44, “on lower” should read -- or lower --.
Line 60, “pulse-light” should read -- pulse light --.
Line 61, “that-the” should read -- that the --.

UNITED STATES PATENT AND TRADEMARK OFFICE

CERTIFICATE OF CORRECTION

PATENT NO. : 6,488,364 B1
DATED : December 3, 2002
INVENTOR(S) : Nakajima et al.

It is certified that error appears in the above-identified patent and that said Letters Patent is hereby corrected as shown below:

Column 11,
Line 16, “7A-7F” should read -- 7A-7F, --.
Line 26, “1a” should read -- $1_a$ --.

Column 12,
Line 28, “is” should read -- to be --.
Line 29, “is” should read -- being --.
Line 30, “$1_b$>1” should read -- $1_b$<1 --.

Column 13,
Line 66, “8A-and” should read -- 8A and --.

Column 15,
Line 29, “continuous 16” should read -- 16 continuous --.
Line 40, “layer,” should read -- later, --.
Line 44, “higher” should read -- higher, --.
Line 65, “5a” should read -- 5 were comprised of a --.

Column 16,
Line 5, “has” should read -- as --.
Line 45, “mixture” should read -- mixture, --.
Line 46, “and” should read -- which --.

Column 17,
Line 59, “12A-12C” should read -- 12A-12C, --.

Column 18,
Line 22, “12A-12C,” should read -- 12A-12C --.

Column 19,
Line 65, “he” should read -- the --.

Column 21,
Line 29, “-nature” should read -- nature --.

Column 22,
Line 66, “mixture” should read -- mixture, --.
Line 67, “and” should read -- which --.

UNITED STATES PATENT AND TRADEMARK OFFICE

CERTIFICATE OF CORRECTION

PATENT NO. : 6,488,364 B1
DATED : December 3, 2002
INVENTOR(S) : Nakajima et al.

It is certified that error appears in the above-identified patent and that said Letters Patent is hereby corrected as shown below:

Column 23,
Line 5, “that is” should read -- that is, --.
Line 60, “passage;” should read -- passage, --.

Column 25,
Line 10, “heading” should read -- head --.

Signed and Sealed this

Twenty-eighth Day of October, 2003

JAMES E. ROGAN
*Director of the United States Patent and Trademark Office*